US009994342B2

(12) United States Patent
Furuse et al.

(10) Patent No.: US 9,994,342 B2
(45) Date of Patent: Jun. 12, 2018

(54) VACUUM PACKAGING METHOD AND VACUUM PACKAGING APPARATUS

(71) Applicant: TOSEI CORPORATION, Izunokuni-shi, Shizuoka (JP)

(72) Inventors: Yoshiaki Furuse, Izunokuni (JP); Tatsuya Asari, Izunokuni (JP); Toshitaka Fukase, Izunokuni (JP)

(73) Assignee: TOSEI CORPORATION, Tokyo (JP)

( * ) Notice: Subject to any disclaimer, the term of this patent is extended or adjusted under 35 U.S.C. 154(b) by 605 days.

(21) Appl. No.: 14/388,642

(22) PCT Filed: Mar. 21, 2013

(86) PCT No.: PCT/JP2013/059163
§ 371 (c)(1),
(2) Date: Sep. 26, 2014

(87) PCT Pub. No.: WO2013/146966
PCT Pub. Date: Oct. 3, 2013

(65) Prior Publication Data

US 2015/0040517 A1 Feb. 12, 2015

(30) Foreign Application Priority Data

Mar. 27, 2012 (JP) ..... 2012-070872

(51) Int. Cl.
*B65B 31/02* (2006.01)
*B65B 51/14* (2006.01)

(52) U.S. Cl.
CPC ..... *B65B 31/024* (2013.01); *B65B 51/146* (2013.01)

(58) Field of Classification Search
CPC ..... B65B 31/024; B65B 51/146
USPC ..... 53/405, 79, 408, 432, 440
See application file for complete search history.

(56) References Cited

U.S. PATENT DOCUMENTS 3,895,475 A * 7/1975 Wolfelsperger ..... B65B 31/021 426/410
3,958,391 A * 5/1976 Kujubu ..... B65B 31/022 53/434
4,132,048 A * 1/1979 Day ..... B65B 31/024 426/410
4,164,111 A * 8/1979 Di Bernardo ..... B65B 31/024 53/434

(Continued)

FOREIGN PATENT DOCUMENTS

CH 525 801 A 7/1972
CN 2302200 Y 12/1998

(Continued)

OTHER PUBLICATIONS

International Search Report of PCT/JP2013/059163 dated Jul. 2, 2013.

(Continued)

*Primary Examiner* — Hemant M Desai
*Assistant Examiner* — Lucas Palmer
(74) *Attorney, Agent, or Firm* — Sughrue Mion, PLLC

(57) ABSTRACT

The invention provides a vacuum packaging method and a vacuum packaging apparatus that can sufficiently degasify the inside of a packaging bag without any trouble and in which bubbles are less likely to remain inside the packaging bag after vacuum packaging, even if a liquid is included in a packaged object.

11 Claims, 22 Drawing Sheets

(56) References Cited

U.S. PATENT DOCUMENTS

| | | | | |
|---|---|---|---|---|
| 4,457,122 | A * | 7/1984 | Atkins | B65B 31/024 53/434 |
| 4,541,224 | A * | 9/1985 | Mugnai | B65B 31/024 53/434 |
| 4,640,081 | A * | 2/1987 | Kawaguchi | B65B 9/067 198/463.3 |
| 4,709,578 | A * | 12/1987 | Iwasaki | G01M 3/363 73/49.3 |
| 4,728,004 | A * | 3/1988 | Bonerb | B65D 88/62 222/386.5 |
| 4,779,398 | A * | 10/1988 | Glandon | B65B 31/022 53/434 |
| 4,922,686 | A * | 5/1990 | Segota | B65B 31/024 53/434 |
| 4,926,614 | A * | 5/1990 | Costello | B65B 31/06 53/434 |
| 5,044,142 | A * | 9/1991 | Gianelli | B65B 31/024 53/434 |
| 5,056,292 | A * | 10/1991 | Natterer | B29C 65/18 53/373.4 |
| 5,067,301 | A * | 11/1991 | Shore | A63H 27/10 53/138.8 |
| 5,239,808 | A * | 8/1993 | Wells | B29C 65/228 53/373.7 |
| 5,528,880 | A * | 6/1996 | Landolt | B65B 31/02 53/432 |
| 5,682,727 | A * | 11/1997 | Harte | B65B 31/024 53/434 |
| 6,862,867 | B2 * | 3/2005 | Cady | B29C 65/18 53/432 |
| 2002/0043050 | A1 * | 4/2002 | Costello | B65B 31/024 53/434 |
| 2003/0046907 | A1 * | 3/2003 | Costello | B65B 31/024 53/512 |
| 2004/0060262 | A1 * | 4/2004 | Harges | B29C 65/18 53/434 |
| 2005/0172736 | A1 | 8/2005 | Kumagai et al. | |
| 2008/0156804 | A1 * | 7/2008 | Bardou | A23L 3/02 220/254.1 |
| 2011/0126986 | A1 * | 6/2011 | Cheung | B29C 66/1122 156/350 |
| 2012/0174531 | A1 * | 7/2012 | Rothermel | B65B 31/024 53/432 |

FOREIGN PATENT DOCUMENTS

| | | | |
|---|---|---|---|
| CN | 101616609 | A | 12/2009 |
| EP | 0 077 458 | A1 | 4/1983 |
| EP | 1184284 | A1 | 3/2002 |
| EP | 1925556 | A2 | 5/2008 |
| FR | 2 568 544 | A1 | 2/1986 |
| GB | 1 284 509 | A | 8/1972 |
| GB | 2078658 | A | 1/1982 |
| GB | 2140381 | A | 11/1984 |
| GB | 2200614 | A | 8/1988 |
| JP | 54-134172 | U | 9/1979 |
| JP | 57-17716 | A | 1/1982 |
| JP | 57-41121 | Y2 | 9/1982 |
| JP | 58-82823 | A | 5/1983 |
| JP | 63-96006 | A | 4/1988 |
| JP | 3-120407 | U | 12/1991 |
| JP | 04-339723 | A | 11/1992 |
| JP | 09-048408 | A | 2/1997 |
| JP | 11-043108 | A | 2/1999 |
| JP | 11-152109 | A | 6/1999 |
| JP | 11-227714 | A | 8/1999 |
| JP | 2001-301713 | A | 10/2001 |
| JP | 2002019723 | A | 1/2002 |
| JP | 2004-051225 | A | 2/2004 |
| JP | 2007-276788 | A | 10/2007 |
| JP | 2009-29464 | A | 2/2009 |
| JP | 2009-202902 | A | 9/2009 |
| JP | 2012-007931 | A | 1/2012 |
| WO | 8901440 | A1 | 2/1989 |

OTHER PUBLICATIONS

Communication dated Oct. 20, 2015, issued by the European Patent Office in corresponding European Application No. 13769632.4.
Communication dated May 31, 2017, issued by the European Patent Office in corresponding application No. 16 19 6214.7.

* cited by examiner

FIG. 3

| [°C] | [kPa] | [°C] | [kPa] | [°C] | [kPa] | [°C] | [kPa] | [°C] | [kPa] |
|---|---|---|---|---|---|---|---|---|---|
| 100 | 101.3 | 80 | 47.39 | 60 | 19.94 | 40 | 7.39 | 20 | 2.34 |
| 99 | 97.81 | 79 | 45.51 | 59 | 19.04 | 39 | 7.00 | 19 | 2.20 |
| 98 | 94.35 | 78 | 43.68 | 58 | 18.17 | 38 | 6.63 | 18 | 2.07 |
| 97 | 90.99 | 77 | 41.92 | 57 | 17.33 | 37 | 6.28 | 17 | 1.94 |
| 96 | 87.73 | 76 | 40.22 | 56 | 16.53 | 36 | 5.95 | 16 | 1.82 |
| 95 | 84.57 | 75 | 38.58 | 55 | 15.56 | 35 | 5.63 | 15 | 1.71 |
| 94 | 81.51 | 74 | 36.99 | 54 | 15.02 | 34 | 5.33 | 14 | 1.60 |
| 93 | 78.53 | 73 | 35.46 | 53 | 14.31 | 33 | 5.04 | 13 | 1.50 |
| 92 | 75.65 | 72 | 33.99 | 52 | 13.63 | 32 | 4.76 | 12 | 1.40 |
| 91 | 72.86 | 71 | 32.56 | 51 | 12.98 | 31 | 4.50 | 11 | 1.31 |
| 90 | 70.15 | 70 | 31.19 | 50 | 12.35 | 30 | 4.25 | 10 | 1.23 |
| 89 | 67.53 | 69 | 29.86 | 49 | 11.75 | 29 | 4.01 | 9 | 1.15 |
| 88 | 64.99 | 68 | 28.59 | 48 | 11.18 | 28 | 3.79 | 8 | 1.07 |
| 87 | 62.53 | 67 | 27.36 | 47 | 10.63 | 27 | 3.57 | 7 | 1.00 |
| 86 | 60.14 | 66 | 26.17 | 46 | 10.10 | 26 | 3.37 | 6 | 0.94 |
| 85 | 57.84 | 65 | 25.03 | 45 | 9.60 | 25 | 3.17 | 5 | 0.87 |
| 84 | 55.61 | 64 | 23.93 | 44 | 9.11 | 24 | 2.99 | 4 | 0.81 |
| 83 | 53.45 | 63 | 22.88 | 43 | 8.65 | 23 | 2.81 | 3 | 0.76 |
| 82 | 51.36 | 62 | 21.86 | 42 | 8.21 | 22 | 2.65 | 2 | 0.71 |
| 81 | 49.34 | 61 | 20.88 | 41 | 7.79 | 21 | 2.49 | 1 | 0.66 |

VACUUM PACKAGING METHOD AND VACUUM PACKAGING APPARATUS

CROSS REFERENCE TO RELATED APPLICATIONS

This is a National Stage of International Application No. PCT/JP2013/059163 filed Mar. 21, 2013 (claiming priority based on Japanese Patent Application No. 2012-070872 filed Mar. 27, 2012), the contents of which are incorporated herein by reference in their entirety.

TECHNICAL FIELD

The present invention relates to a vacuum packaging method and vacuum packaging apparatus that vacuum packages a packaged object by, while in a state in which a packaging bag that receives a packaged object is accommodated in a chamber, degassing inside the packaging bag by decompressing inside the chamber, in this state, closing a packaged-object filling opening of the packaging bag, and sealing the packaged-object filling opening that is in a closed state.

BACKGROUND ART

Hitherto, vacuum packaging is known as one of the packaging methods that packages a packaged object such as a foodstuff. Vacuum packaging is performed by accommodating a packaging bag, in which a packaging object is received, in a chamber of a vacuum packaging apparatus, degassing inside the packaging bag by decompressing inside the chamber, and, in this state, sealing a packaged-object filling opening of the packaging bag by heat sealing or the like (for example, see Patent Literature 1).

PRIOR ART REFERENCE

Patent Reference

Patent reference 1: Japanese Unexamined Patent Application Publication No. 2007-276788

SUMMARY OF THE INVENTION

Problem to be Solved by the Invention

Incidentally, when attempting to degasify a packaged object, which is an object of the vacuum packaging, that includes liquid that has a temperature that is higher than a normal temperature, for example, soup, curry, stewed food including broth, a foodstuff that is pickled in heated oil, and the like that are warm succulent dishes, so as to prevent any bubbles from remaining inside the packaging bag after the vacuum packaging by sufficiently decompressing inside the chamber, there is a concern that the liquid becomes boiled and becomes easily boiled out from the packaging bag that is in an open state such that the packaging bag becomes dirty. Furthermore, there is a concern that gas that has been generated by vaporization of the boiling liquid (for example, water vapor generated by boiling of the water) becomes drawn into a degasifier, such as a vacuum pump, and the degasifier becomes adversely affected by the gas (for example, corrosion inside the pump and reduction in the degassing capacity).

The present invention has been made in view of the above-described circumstance and an object thereof is to attempt to provide a vacuum packaging method and a vacuum packaging apparatus that is capable of sufficiently degassing inside a packaging bag without any trouble and in which bubbles are less likely to remain inside the packaging bag after the vacuum packaging, even if liquid is included in a packaged object.

Means for Solving the Problems

The present invention has been proposed to achieve the above-described object and a vacuum packaging method stated in claim 1 is a vacuum packaging method that, while in a state in which a packaging bag that receives a packaged object including a liquid is accommodated in a chamber, vacuum packages the packaged object by degassing inside the packaging bag by decompressing inside the chamber, closes a packaged-object filling opening of the packaging bag in this state, and seals the packaged-object filling opening that is in a closed state, the vacuum packaging method comprising the steps of:

decompressing a package by, after decompressing inside the chamber to a before-closing-filling-opening set pressure that has been set in advance, closing the packaged-object filling opening inside the chamber and, in this state, decompressing inside the chamber to a when-opening-filling-opening set pressure that is lower than the before-closing-filling-opening set pressure;

canceling the closing after the decompressing of the package so as to cancel the closed state of the packaged-object filling opening inside the chamber; and sealing, after the canceling of the closing, by closing the package-object filling opening again and sealing the packaged-object filling opening in the close state.

The vacuum packaging method stated in claim 2 is a vacuum packaging method according to claim 1, in which in the decompressing of the package, an inflation of the packaging bag, the packaging bag of which the packaged-object filling opening has been closed, is detectable with inflation detection means, and when the chamber is decompressed inside to the when-opening-filling-opening set pressure and when the packaging bag becomes inflated, the inflation of the packaging bag is detected by the inflation detection means, and based on the detection, degassing inside the chamber is stopped.

The vacuum packaging method stated in claim 3 is a vacuum packaging method according to claim 2 in which, the inflation of the packaging bag is detectable by abutting the inflation detection means against an upper portion of the packaging bag, and in the canceling of the closing, the inflation detection means squashes the packaging bag that is in an inflated state.

The vacuum packaging method stated in claim 4 is a vacuum packaging method according to any one of claims 1 to 3, including a step of decompressing, before the decompression of the package, in a preparatory manner inside the chamber at a second decompression rate that is slower than the first decompression rate to the before-closing-filling-opening set pressure after decompressing inside the chamber at a first decompression rate to a preparatory set pressure that is higher than the before-closing-filling-opening set pressure.

The vacuum packaging method stated in claim 5 is a vacuum packaging method according to claim 4, in which the before-closing-filling-opening set pressure is set at a pressure at which the liquid, the liquid being included in the packaged object, boils at the temperature of when received inside the packaging bag.

A vacuum packaging apparatus stated in claim 6 is a vacuum packaging apparatus including a chamber that accommodates a packaging bag in which a packaged object including a liquid is received; a degasifier that degasses inside the packaging bag by decompressing inside the chamber; a filling-opening closing device that is provided inside the chamber, the filling-opening closing device closing a packaged-object filling opening of the packaging bag; a sealing device that seals the packaged-object filling opening that is in a closed state; and a controller that controls the degasifier, the filling-opening closing device, and the sealing device, in which the controller includes package decompression control means that controls the degasifier and after decompressing inside the chamber to a before-closing-filling-opening set pressure that has been set in advance, controls the filling-opening closing device inside the chamber to close the package-object filling opening, and, in this state, controls the degasifier to decompress inside the chamber to a when-opening-filling-opening set pressure that is lower than the before-closing-filling-opening set pressure, closing cancellation control means that, inside the chamber that has been decompressed to the when-opening-filling-opening set pressure by the package decompression control means, controls the filling-opening closing device so as to cancel the close state of the packaged-object filling opening, and sealing control means that, after the closed state of the packaged-object filling opening has been canceled by the closing cancellation control means, controls the filling-opening closing device so as to close the packaged-object filling opening again and, in the close state, performs sealing with the sealing device.

The vacuum packaging apparatus stated in claim 7 is a vacuum packaging apparatus according to claim 6, including inflation detection means that is capable of detecting an inflation of the packaging bag inside the chamber, in which when the chamber is decompressed inside to a when-opening-filling-opening set pressure and when the packaging bag, the packaged-object filling opening of which is in a closed state, becomes inflated, the inflation detection means detects the inflation of the packaging bag and based on the detection, the controller stops degassing inside the chamber.

The vacuum packaging apparatus stated in claim 8 is a vacuum packaging apparatus according to claim 7, in which the inflation detection means includes a bag abutting portion that abuts against an upper portion of the packaging bag, the bag abutting portion being provided so as to be capable of being moved up and down, and that is capable of squashing the packaging bag in an inflated state.

The vacuum packaging apparatus stated in claim 9 is a vacuum packaging apparatus according to any one of claims 6 to 8, in which the degasifier includes a vacuum pump and a decompression regulating mechanism that is capable of switching the decompression rate inside the chamber, the chamber being decompressed by driving of the vacuum pump, between a first decompression rate that has been set in advance and a second decompression rate that is slower than the first decompression rate, the controller includes preparatory decompression control means that controls the degasifier and, after decompressing inside the chamber at the first decompression rate to a preparatory set pressure that is higher than the before-closing-filling-opening set pressure, decompresses inside the chamber at a second decompression rate to the before-closing-filling-opening set pressure.

The vacuum packaging apparatus stated in claim 10 is a vacuum packaging apparatus according to claim 9, in which the decompression regulating mechanism includes a suction-air flow path that is capable of communicating the vacuum pump and the chamber to each other, a bypass flow path that is set with a flow path resistance that is larger than that of the suction-air flow path, the bypass flow path being capable of communicating the vacuum pump and the chamber to each other while bypassing the suction-air flow path, and a flow path switching valve that is capable of switching between a suction-air communicating state that communicates the vacuum pump and the chamber through the suction-air flow path and a bypass communicating state that communicates the vacuum pump and the chamber through the bypass flow path, and when the vacuum pump is driven while the flow path switching valve is switched to the suction-air communicating state, the chamber is decompressed inside at the first decompression rate, and when the vacuum pump is driven while the flow path switching valve is switched to the bypass communicating state, the chamber is decompressed inside at the second decompression rate.

The vacuum packaging apparatus stated in claim 11 is a vacuum packaging apparatus according to any one of claims 6 to 10, including a temperature detection sensor that is capable of detecting a temperature of the packaged object inside the packaging bag accommodated in the chamber and that is capable of transmitting to the controller information of the temperature detected, in which the controller sets a pressure at which the liquid boils at the temperature detected by the temperature detection sensor as the before-closing-filling-opening set pressure.

Effect of the Invention

According to the present invention, the following advantageous effect can be exerted.

According to the invention of claims 1 and 6, in the vacuum packaging method and a vacuum packaging apparatus that, while in a state in which a packaging bag that receives a packaged object including a liquid is accommodated in a chamber, vacuum packages the packaged object by degassing inside the packaging bag by decompressing inside the chamber, closing a packaged-object filling opening of the packaging bag in this state, and sealing the packaged-object filling opening that is in a closed state, since the packaged object is vacuum packaged by decompressing a package by, after decompressing inside the chamber to a before-closing-filling-opening set pressure that has been set in advance, closing the packaged-object filling opening inside the chamber and, in this state, decompressing inside the chamber to a when-opening-filling-opening set pressure that is lower than the before-closing-filling-opening set pressure; canceling the closing after the decompressing of the package so as to cancel the closed state of the packaged-object filling opening inside the chamber; and sealing, after the canceling of the closing, by closing the package-object filling opening again and sealing the packaged-object filling opening in the close state, even if the before-closing-filling-opening set pressure is set at a pressure in which the liquid boils (specifically, a pressure that allows boiling when the inside of the packaging bag is in a state of high temperature), in other words, even if the chamber is decompressed inside to a pressure at which the liquid boils and even if the inside of the packaging bag is sufficiently degassed, a trouble in that the boiling liquid boils out from the packaging bag can be prevented by closing the packaged-object filling opening, and the packaged-object filling opening can be prevented from becoming dirty from liquid. Accordingly, even if a liquid is included in the packaged object, it is possible to sufficiently degasify inside the packaging bag without any trouble; accordingly, bubbles are less likely to remain inside the packaging bag after the vacuum packaging and it is possible to perform the vacuum packaging in a desirable manner. Furthermore, it is less likely for the gas that has been generated by boiling of the water to be drawn into the degasifier; accordingly, it is possible to suppress a defect from occurring in the degasifier due to drawing in the gas.

According to the invention stated in claims 2 and 7, in the decompressing of the package, an inflation of the packaging bag of which the packaged-object filling opening has been closed is detectable with inflation detection means, and when the chamber is decompressed inside to the when-opening-filling-opening set pressure and when the packaging bag becomes inflated, the inflation of the packaging bag is detected by the inflation detection means, and based on the detection, degassing inside the chamber is stopped; accordingly, it is easy to understand the timing to stop the degassing inside the chamber on the basis of the inflation of the packaging bag, in other words, the boiling state of the liquid. Accordingly, a trouble such as excessive decompression inside the chamber and, consequently, a trouble in that a large amount of vapored gas, which is the result of excessive boiling of the liquid inside the packaging bag, being drawn into the degasifier can be avoided.

According to the invention stated in claims 3 and 8, the inflation of the packaging bag is detectable by abutting the inflation detection means against an upper portion of the packaging bag and, in the closing cancellation process, the inflation detection means squashes the packaging bag in the inflated state; accordingly, the air remaining inside the packaging bag can be forced to the outside by using the configuration that detects the inflated state of the packaging bag and the inside of the packaging bag can be degassed sufficiently. Accordingly, it is possible to perform vacuum packaging in a desirable manner that is less likely to contain residue air.

According to the invention stated in claims 4 and 9, the vacuum packaging method includes a step of decompressing, before the decompression of the package, in a preparatory manner inside the chamber at a second decompression rate that is slower than the first decompression rate to the before-closing-filling-opening set pressure after decompressing inside the chamber at a first decompression rate to a preparatory set pressure that is higher than the before-closing-filling-opening set pressure; accordingly, a trouble in that the packaging bag being rapidly decompressed inside generating bumping of the liquid can be averted.

According to the invention stated in claims 5 and 11, the before-closing-filling-opening set pressure is set at a pressure in which the liquid, the liquid being included in the packaged object, boils at the temperature of when received inside the packaging bag; accordingly, it is possible to force the air inside the packaging bag to the outside with the gas generated through boiling of the liquid and the inside of the packaging bag can be degassed in a further sufficient manner. Accordingly, it is possible to perform vacuum packaging in a desirable manner that is further less likely to contain residue air.

According to the invention stated in claim 10, the decompression regulating mechanism, which can switch the decompression rate inside the chamber between a first decompression rate that has been set in advance and a second decompression rate that is slower than the first decompression rate, includes a suction-air flow path that is capable of communicating the vacuum pump and the chamber to each other, a bypass flow path that is set with a flow path resistance that is larger than that of the suction-air flow path, the bypass flow path being capable of communicating the vacuum pump and the chamber to each other while bypassing the suction-air flow path, and a flow path switching valve that is capable of switching between a suction-air communicating state that communicates the vacuum pump and the chamber through the suction-air flow path and a bypass communicating state that communicates the vacuum pump and the chamber through the bypass flow path, and when the vacuum pump is driven while the flow path switching valve is switched to the suction-air communicating state, the chamber is decompressed inside at the first decompression rate, and when the vacuum pump is driven while the flow path switching valve is switched to the bypass communicating state, the chamber is decompressed inside at the second decompression rate; accordingly, the decompression regulating mechanism can be made with a simple configuration.

BRIEF DESCRIPTION OF THE DRAWINGS

FIG. 3 is a water vapor pressure table.

MODES FOR CARRYING OUT THE INVENTION

Hereinafter, modes for carrying out the invention will be described with reference to the drawings.

Figure 1:
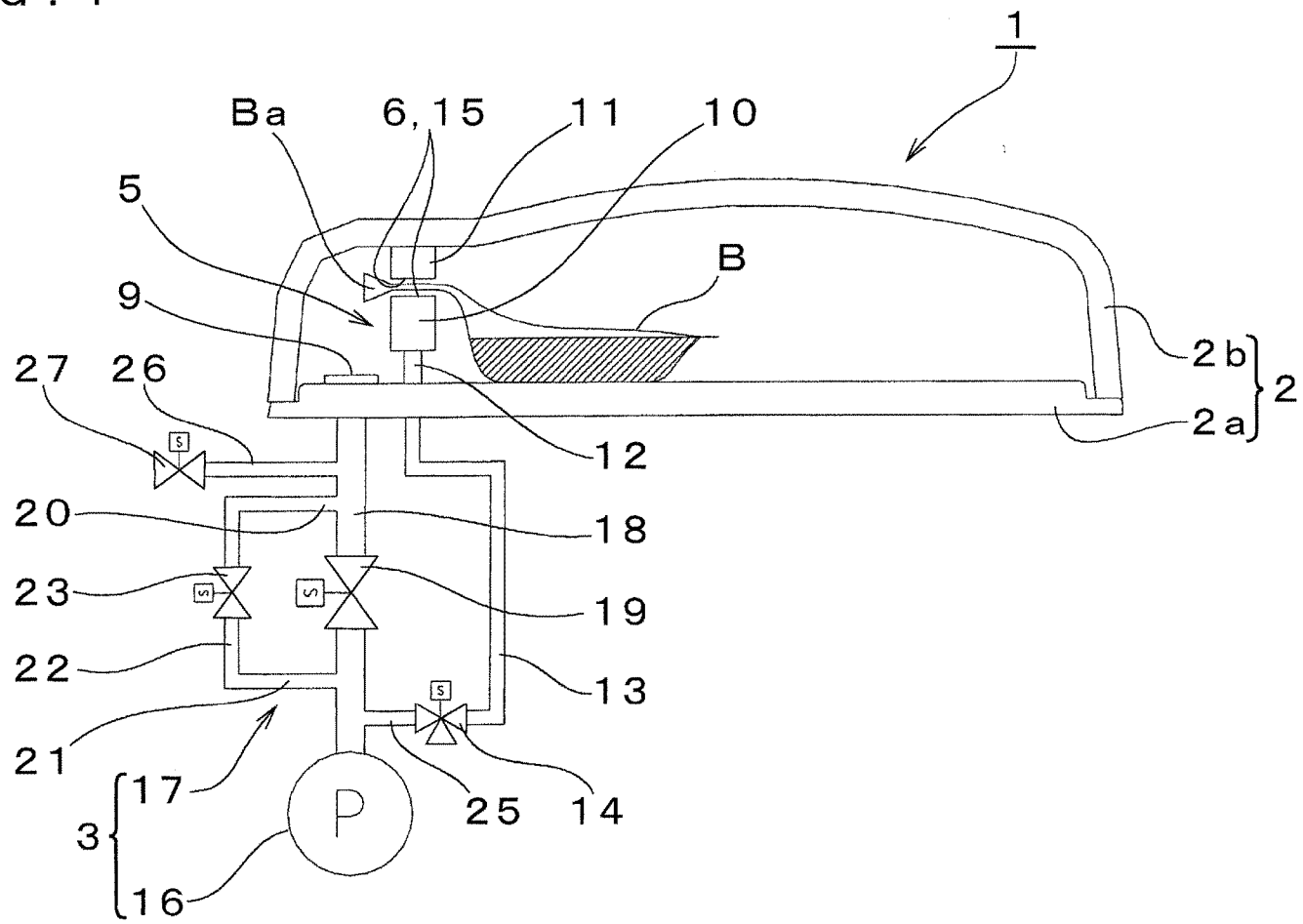
FIG. 1 is a schematic diagram of a vacuum packaging apparatus.
Figure 2:
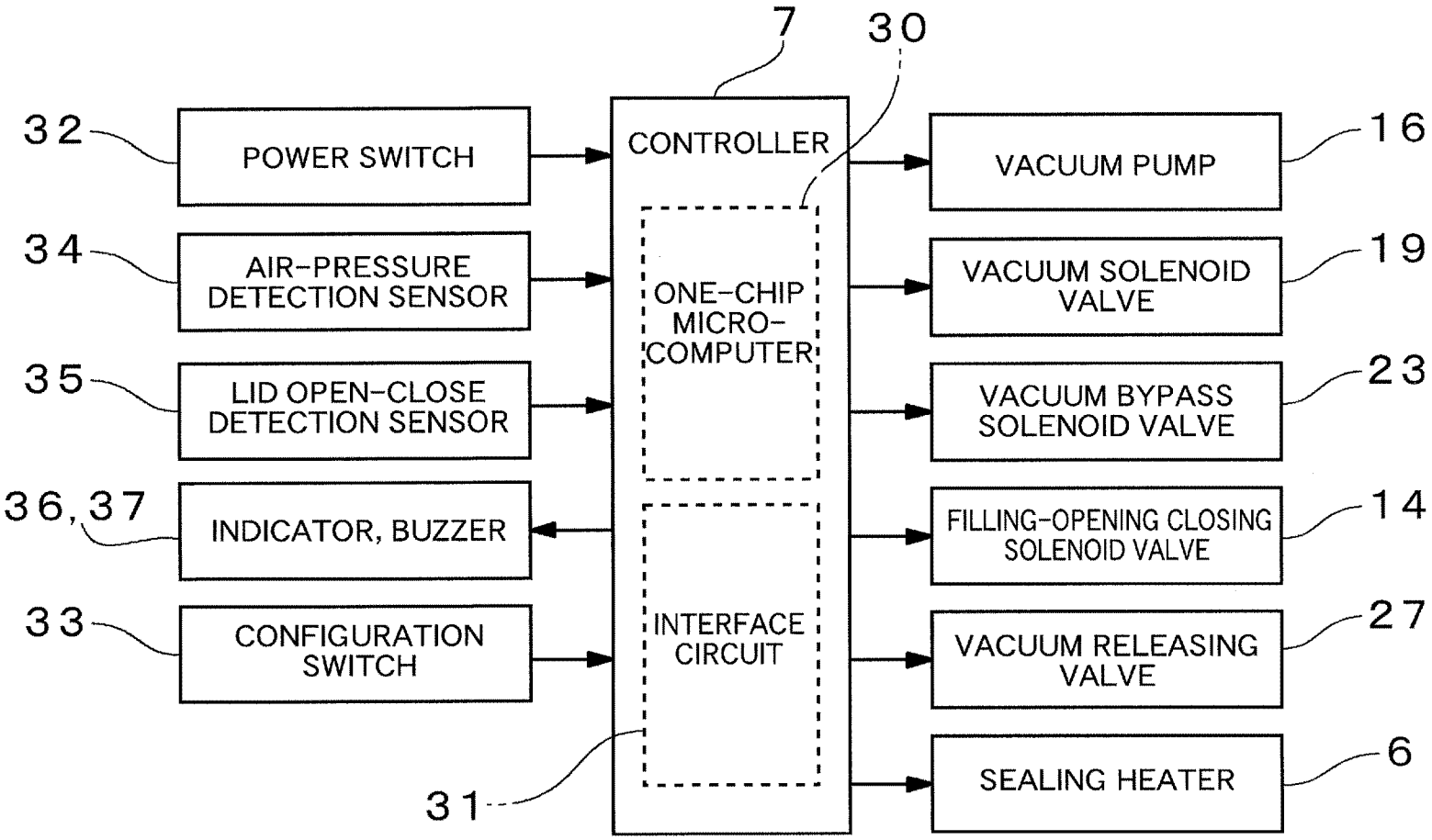
FIG. 2 is a block diagram illustrating a control system of the vacuum packaging apparatus.

A vacuum packaging apparatus 1, as illustrated in FIGS. 1 and 2, includes a chamber 2 that accommodates a packaging bag B in which a packaged object is received, a degasifier 3 that degasses inside the packaging bag B by decompressing inside the chamber 2, a filling-opening closing device 5 that is provided inside the chamber 2 and that closes a packaged-object filling opening Ba of the packaging bag B, sealing heaters 6 (corresponding to a sealing device of the present invention) that seals the packaged-object filling opening Ba of the packaging bag B, and a controller 7 that controls the degasifier 3, the filling-opening closing device 5, and the sealing heaters 6. Note that the degasifier 3 will be described later in detail.

The chamber 2 is a pressure-resistant container that is constituted by a body portion 2*a* that is capable of mounting the packaging bag B on the upper surface thereof and a lid portion 2*b* that closes the body portion 2*a* from above and is configured such that the lid portion 2*b* is capable of being opened and closed by being pivoted in the up-down direction and such that airtightness inside the chamber 2 is maintained by providing a sealing material (not shown) at a portion where the lid portion 2*b* and the body portion 2*a* are in contact with each other. Furthermore, a suction opening 9 is drilled in the body portion 2*a* and is connected to the degasifier 3 such that when the degasifier 3 is driven, air inside the chamber 2 is drawn out from the suction opening 9 and the chamber 2 is decompressed inside.

The filling-opening closing device 5 includes, in an opposing state, a lower side closing block 10 that is provided on the body portion 2*a* side in a state allowing the lower side closing block 10 to be lifted and lowered and an upper side closing block 11 that is fixed to the undersurface side of the lid portion 2*b*, in which the lower side closing block 10 is capable of being lifted and lowered by driving of a closing cylinder 12 and the packaged-object filling opening Ba is closed by pinching the packaging bag B between the upper side closing block 11 and the lower side closing block 10 that is in a lifted state. Furthermore, the closing cylinder 12 and the degasifier 3 are connected by a filling-opening closing drive flow path 13, and, one of the connection ports of a filling-opening closing solenoid valve 14 constituted by a three-way valve is connected to the filling-opening closing drive flow path 13, one of the remaining connection ports is connected to a portion of the degasifier 3, and the other one of the remaining connection ports is opened to the atmosphere. Moreover, by operating the filling-opening closing solenoid valve 14, the closing cylinder 12 and the degasifier 3 are brought into communication with each other such that air inside the closing cylinder 12 is suctioned with the degasifier 3, and the closing cylinder 12 elevates and presses the lower side closing block 10 against the upper side closing block 11 (see FIG. 7(*a*)). When the inside of the closing cylinder 12 is released to the atmosphere, the closing cylinder 12 separates the lower side closing block 10 downwards from the upper side closing block 11 (see FIG. 5(*a*)). Furthermore, the sealing heaters 6 are each provided on the upper side closing block 11 side (the upper portion) of the lower side closing block 10 and on the lower side closing block 10 side (the lower portion) of the upper side closing block 11, and when the sealing heaters 6 are energized while in a state in which the packaging bag B is pinched between the upper side closing block 11 and the lower side closing block 10, the packaged-object filling opening Ba are, while in the close state, heat pressure-jointed and sealed.

Furthermore, a bag pinching surface (the upper surface) of the lower side closing block 10 and a bag pinching surface (undersurface) of the upper side closing block 11 are each provided with a bag adhesive portion 15 that is constituted by a gel sheet (for example, a silicone rubber sheet) that has heat resistance and adhesiveness such that the bag adhesive portions 15 are adhered to the surface of the packaging bag B so that not only a trouble in that the packaged-object filling opening Ba of the packaging bag B in the pinched state is displaced, consequently, but also a trouble in that the packaging bag B in the pinched state slips out from between the upper side closing block 11 and the lower side closing block 10 can be prevented. Note that the bag adhesive portions 15 are disposed at positions that are displaced from the sealing heaters 6 (specifically, on the pivotal center side (the right side of FIG. 1) of the lid portion 2*b* with respect to the sealing heater 6).

Next, the degasifier 3 will be described.

The degasifier 3 includes a vacuum pump 16 and a decompression regulating mechanism 17 that is connected between the vacuum pump 16 and the chamber 2. The decompression regulating mechanism 17 includes a suction-air flow path 18 that is capable of communicating the vacuum pump 16 and the chamber 2 to each other, and midway of the suction-air flow path 18, a vacuum solenoid valve 19 (a type of flow path switching valve according to the present invention) that allows or cancels communication between the vacuum pump 16 and the chamber 2 is provided. Furthermore, in the suction-air flow path 18, a chamber-side branching port 20 is provided between the chamber 2 and the vacuum solenoid valve 19, and a pump-side branching port 21 is provided between the vacuum pump 16 and the vacuum solenoid valve 19, and, the chamber-side branching port 20 and the pump-side branching port 21 are connected with a bypass flow path 22 such that the vacuum pump 16 and the chamber 2 can be in communication with each other with the bypass flow path 22 while bypassing the suction-air flow path 18. Furthermore, midway of the bypass flow path 22, a vacuum bypass solenoid valve 23 (a type of flow path switching valve according to the present invention) that allows or cancels communication between the vacuum pump 16 and the chamber 2 is provided. Moreover, the flow path diameter of the bypass flow path 22 and the orifice diameter of the vacuum bypass solenoid valve 23 are formed smaller than the flow path diameter of the suction-air flow path 18, or a throttle valve (not shown) is disposed midway of the bypass flow path 22, such that the flow path resistance of the bypass flow path 22 is set larger than that of the suction-air flow path 18.

The decompression regulating mechanism 17 (the degasifier 3) provided with such a configuration is, by operating the vacuum solenoid valve 19 and the vacuum bypass solenoid valve 23, capable of switching the communication state between the vacuum pump 16 and the chamber 2. Specifically, when the vacuum solenoid valve 19 is opened and the vacuum bypass solenoid valve 23 is closed, a suction-air communicating state, which is a state in which the vacuum pump 16 and the chamber 2 are in communication with each other through the suction-air flow path 18 without passing the bypass flow path 22, is achieved (see FIG. 5(*a*)), and when the vacuum solenoid valve 19 is closed and the vacuum bypass solenoid valve 23 is opened, a bypass communicating state, which is a state in which the vacuum pump 16 and the chamber 2 are in communication with each other through the bypass flow path 22 without passing through the suction-air flow path 18, is achieved. Moreover, when the vacuum solenoid valve 19 and the vacuum bypass solenoid valve 23 are operated and are switched to the suction-air communicating state and, in this state, when the chamber 2 is decompressed inside by driving the vacuum pump 16, the chamber 2 is decompressed inside at a first decompression rate that has been set in advance. On the other hand, when the vacuum solenoid valve 19 and the vacuum bypass solenoid valve 23 are operated and are switched to the bypass communicating state and when, in this state, the chamber 2 is decompressed inside by driving the vacuum pump 16, the chamber 2 is decompressed inside at a second decompression rate that is slower than the first decompression rate. In other words, the decompression regulating mechanism 17 is configured such that the decompression rate in the chamber 2 decompressed by driving of the vacuum pump 16 can be switched between the first decompression rate that has been set in advance and the second decompression rate that is slower than the first decompression rate.

Note that, in the suction-air flow path 18, a portion positioned between the pump-side branching port 21 and the vacuum pump 16 is provided with a closing branching port 25, and one of the connection ports of the filling-opening closing solenoid valve 14 is connected to the closing branching port 25. Furthermore, in the suction-air flow path 18, a portion between the chamber-side branching port 20 and the chamber 2 is provided with a vacuum releasing branching port 26, and a vacuum releasing valve 27 is connected thereto such that the inside of the chamber 2 can be returned to atmospheric pressure (can perform atmospheric release) from the decompressed state by opening the vacuum releasing valve 27.

The controller 7 includes, as illustrated in FIG. 2, a one-chip microcomputer 30 that performs control of the vacuum packaging apparatus 1, an interface circuit 31 that performs input-output processes of various signals, and the like. Moreover, the interface circuit 31 is input with signals from various operation switches such as a power switch 32, configuration switches 33 for pressure and time, and the like that are provided in the control panel (not shown) of the vacuum packaging apparatus 1, an air-pressure detection sensor (pressure sensor) 34 that detects the air pressure inside the chamber 2, and a lid open-close detection sensor 35 that detects the open-closed state of the lid portion 2*b*. Furthermore, the interface circuit 31 outputs control signals to the vacuum pump 16, the vacuum solenoid valve 19, the vacuum bypass solenoid valve 23, the filling-opening closing solenoid valve 14, the vacuum releasing valve 27, the sealing heaters 6, a buzzer 36 that sounds various alarm sounds, and an indicator 37 that indicates various statuses. Moreover, target values of the air pressure, (a first set pressure P1 (corresponding to a preparatory set pressure according to the present invention), a second set pressure P2 (corresponding to a before-closing-filling-opening set pressure according to the present invention) that is lower than the first set pressure P1, a third set pressure P3 (corresponding to a when-opening-filling-opening set pressure according to the present invention) that is lower than the second set pressure P2)) inside the chamber 2 during the vacuum packaging operation are set in advance by, for example, an operator performing input operations with the configuration switches 33, and the operation of the vacuum packaging apparatus 1 is controlled while the air pressure detected by the air-pressure detection sensor 34 reaching the first set pressure P1, the second set pressure P2, and the third set pressure P3 serve as triggers.

Figure 4:
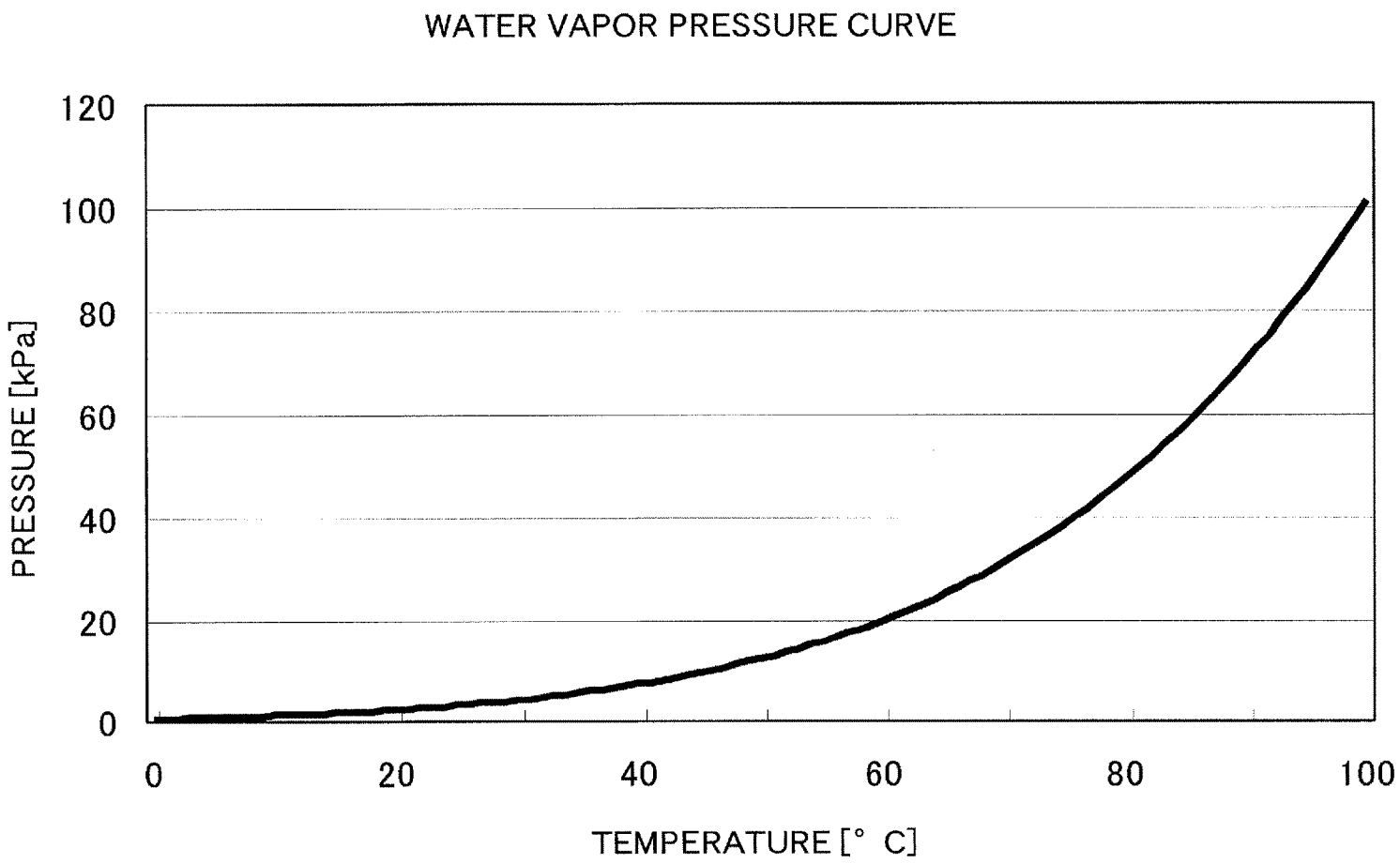
FIG. 4 is a water vapor pressure curve.

Next, in the vacuum packaging apparatus 1 with the configuration described above, a process of vacuum packaging a packaged object that includes a liquid that has a temperature that is higher than a normal temperature will be described. Note that in this embodiment, the liquid that is included in the packaged object is water that has a temperature that is higher (for example 80° C.) than the normal temperature. Furthermore, in a state before the start of the vacuum packaging (a normal state), the vacuum pump 16 is not driven, all the connection ports of the vacuum solenoid valve 19, the vacuum bypass solenoid valve 23, and the filling-opening closing solenoid valve 14 are in a closed state (N, C), and the vacuum releasing valve 27 is in an open state (N, O) (see FIG. 5(*b*)). Furthermore, the inside of the filling-opening closing drive flow path 13 and the inside of the closing cylinder 12 are not decompressed and the lower side closing block 10 is in a lowered state. Moreover, the target values (the first set pressure P1, the second set pressure P2, and the third set pressure P3) of the air pressure inside the chamber 2 during the vacuum packaging operation are set in advance on the basis of temperatures of the liquid (water) included in the packaged object. Specifically, the operator performs input operations with the configuration switches 33, for example, to set the second set pressure P2 at a pressure that boils the water that has a high temperature included in the packaged object (specifically, the pressure at which boiling starts). For example, when the water temperature is 80° C., the second set pressure P2 is set at 47.39 kPa (see FIGS. 3 and 4). Furthermore, in advance, the first set pressure P1 is set higher than the second set pressure P2 (for example, 10 kPa higher than the second set pressure P2) at a pressure at which the water that has a high temperature included in the packaged object does not boil, and the third set pressure P3 is set lower than the second set pressure P2 (for example, 10 kPa lower than the second set pressure P2) at a pressure at which the water that has a high temperature included in the packaged object boils.

First, a setting process (a preparation process) of setting the packaging bag B filled with the packaged object inside the chamber 2 is performed. In the setting process, while the lid portion 2*b* is in an open state, the operator mounts the packaging bag B on the body portion 2*a* and mounts the packaged-object filling opening Ba on the lower side closing block 10. After setting the packaging bag B, when the lid portion 2*b* is manually closed, the lid open-close detection sensor 35 detects the closed state of the lid portion 2*b* and sends a signal to the controller 7.

Figure 5A:
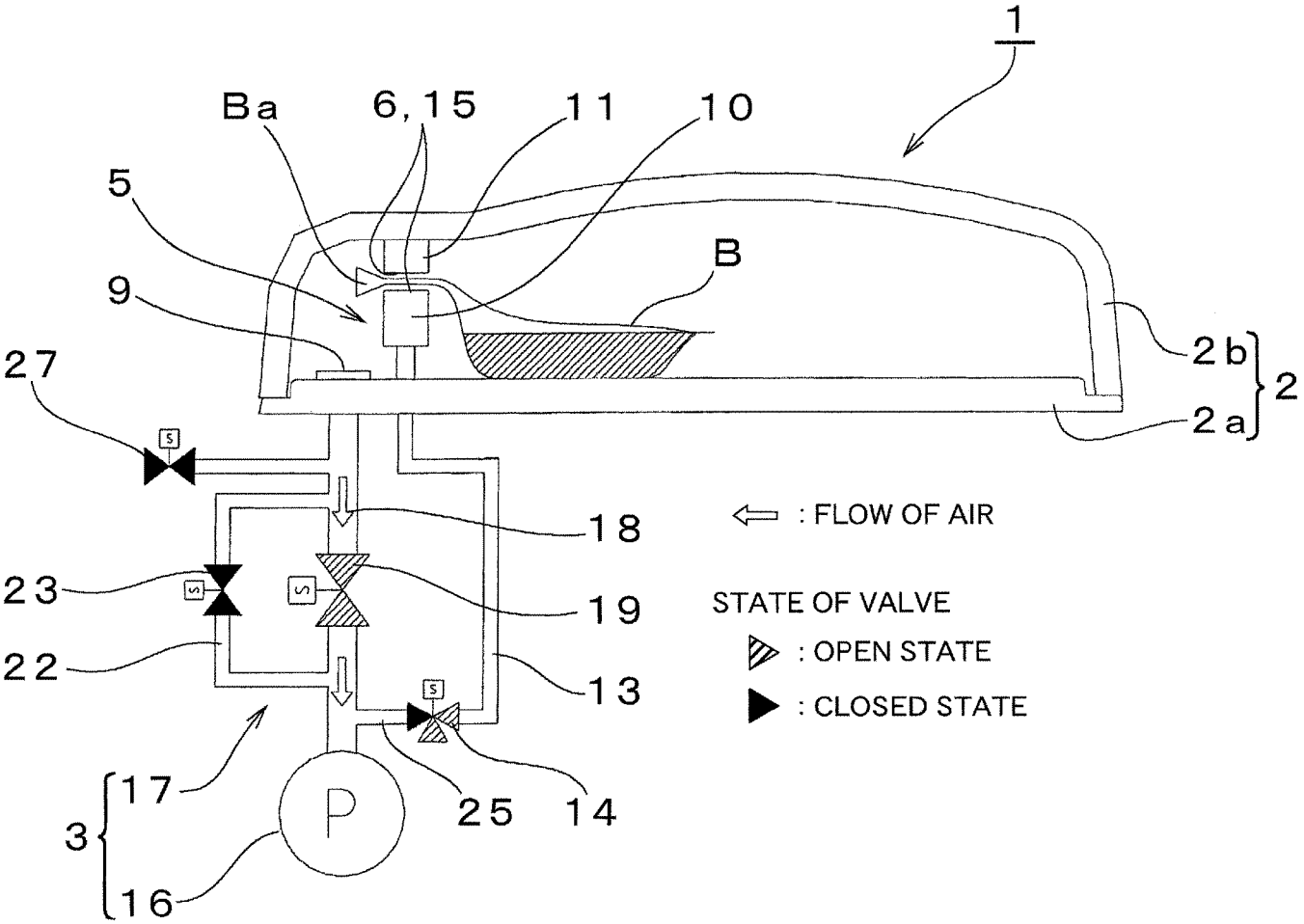
FIGS. 5(*a*) and 5(*b*) illustrates explanatory drawings of the vacuum packaging apparatus that decompresses inside a chamber to a first set pressure in a preparatory decompression process, of which FIG. 5(*a*) is a schematic diagram and FIG. 5(*b*) is a timing chart.
Figure 5B:
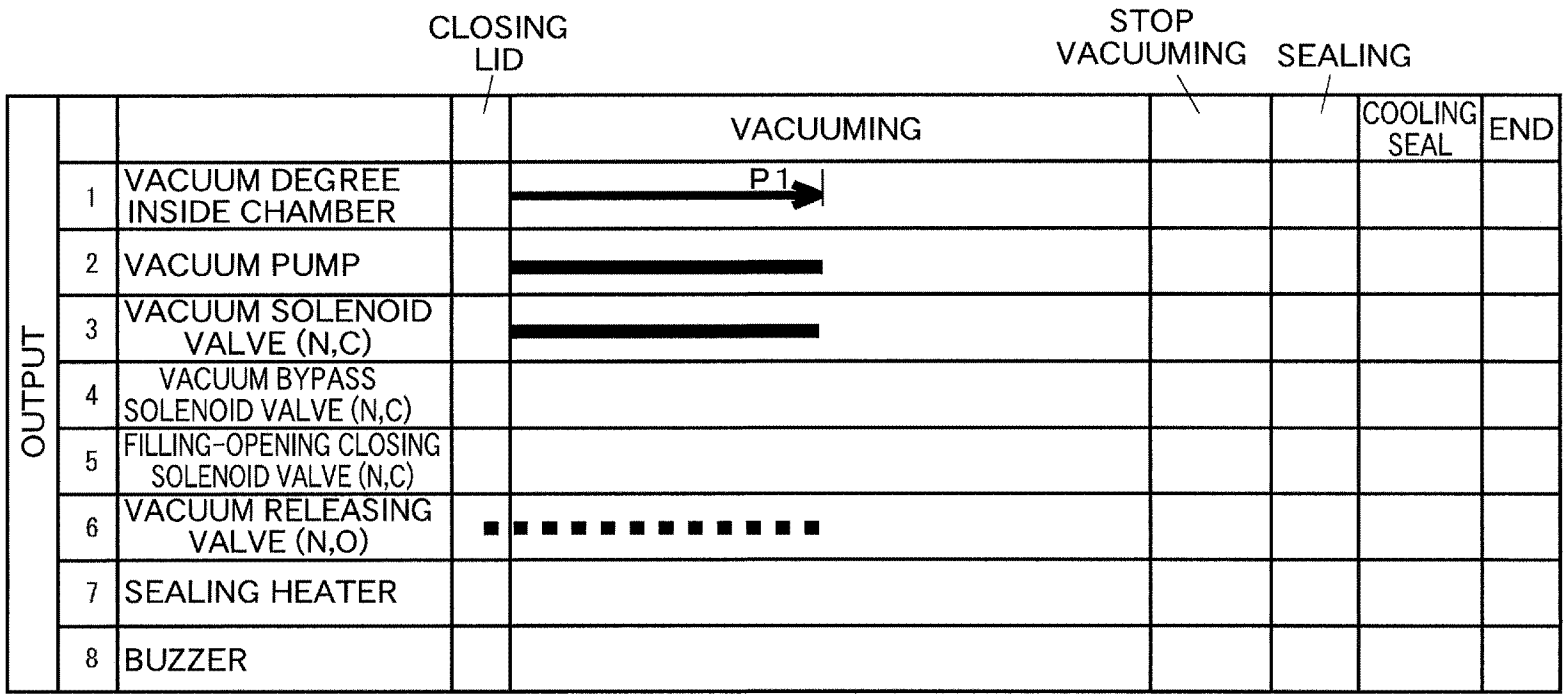
Figure 6A:
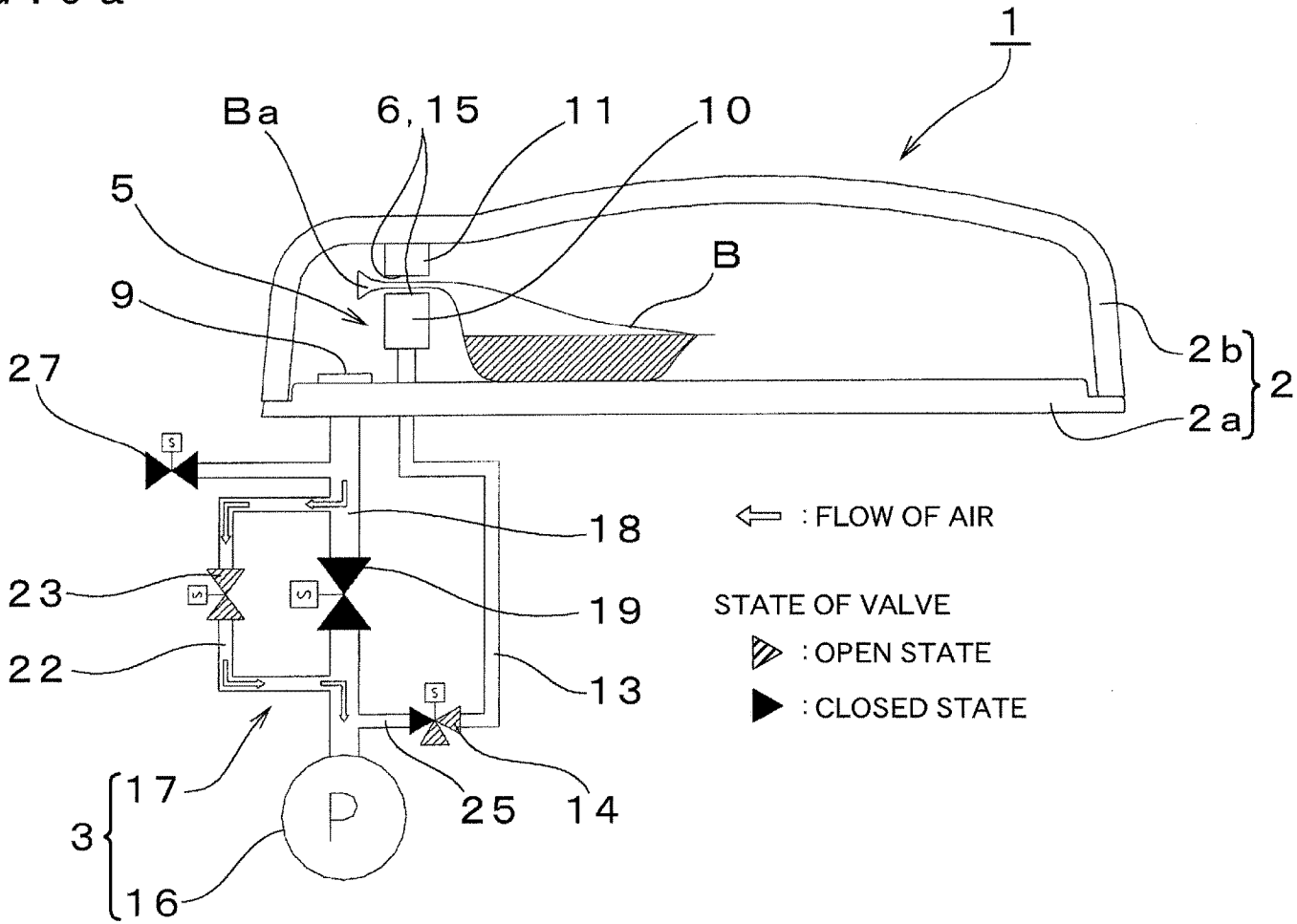
FIGS. 6(*a*) and 6(*b*) illustrate explanatory drawings of the vacuum packaging apparatus that decompresses inside the chamber to a second set pressure in the preparatory decompression process, of which FIG. 6(*a*) is a schematic diagram and FIG. 6(*b*) is a timing chart.
Figure 6B:
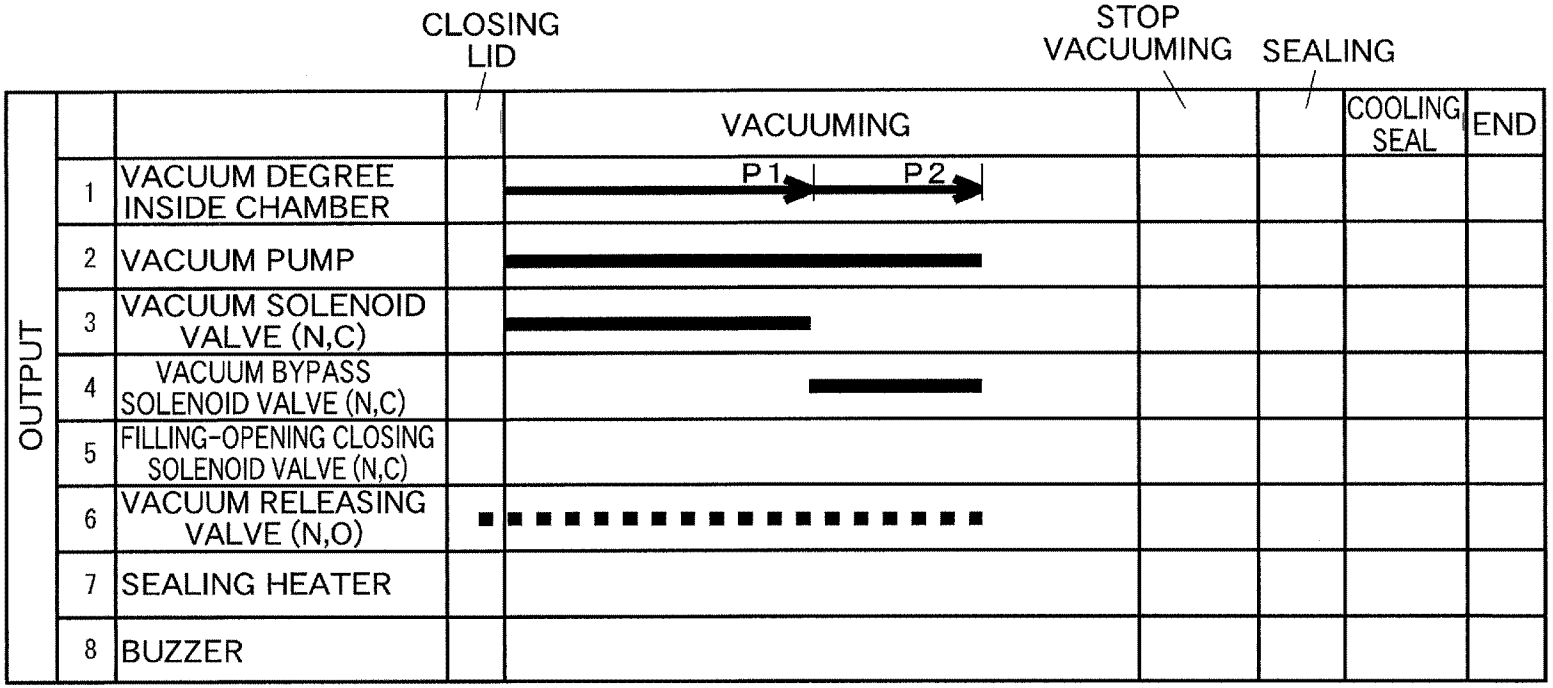

When the controller 7 receives the detection signal of the closed state of the lid portion 2*b*, the process proceeds to a preparatory decompression process. In the preparatory decompression process, the controller 7 functions as preparatory decompression control means and controls the decompression operation inside the chamber 2. Specifically, as illustrated in FIGS. 5(*a*) and 5(*b*), the vacuum solenoid valve 19 is opened and the closed state of the vacuum bypass solenoid valve 23 is maintained such that the decompression regulating mechanism 17 is in a suction-air communicating state, and the vacuum releasing valve 27 is closed. Furthermore, in the filling-opening closing solenoid valve 14, while the connection port on the atmospheric releasing side and the connection port on the filling-opening closing drive flow path 13 side are open, the closed state of the connection port on the closing branching port 25 side is maintained. Upon completion of the operation of each of the solenoid valves 14, 19, and 23 and the vacuum releasing valve 27, the vacuum pump 16 is driven and decompression inside the chamber 2 is started such that degassing inside the packaging bag B is performed. At this time, since the air inside the chamber 2 passes through the suction-air flow path 18 and is drawn into the vacuum pump 16, the chamber 2 is decompressed inside at the first decompression rate. Then, the air-pressure detection sensor 34 detects the air pressure inside the chamber 2 and transmits a detection signal to the controller 7, and when the controller 7 determines that the air pressure inside the chamber 2 is decompressed to the preset first set pressure P1, the controller 7, as illustrated in FIGS. 6(*a*) and 6(*b*), keeps on driving the vacuum pump 16, maintains the open-closed state of each connection port of the filling-opening closing solenoid valve 14 and the closed state of the vacuum releasing valve 27, and closes the vacuum solenoid valve 19 and opens the vacuum bypass solenoid valve 23 so as to switch the decompression regulating mechanism 17 to the bypass communicating state. With the above, since the air inside the chamber 2 passes through the bypass flow path 22 and is drawn into the vacuum pump 16, the chamber 2 is decompressed inside at the second decompression rate that is slower than the first decompression rate. Accordingly, a trouble in that the packaging bag B being rapidly decompressed inside generating bumping of the liquid can be averted.

Figure 7A:
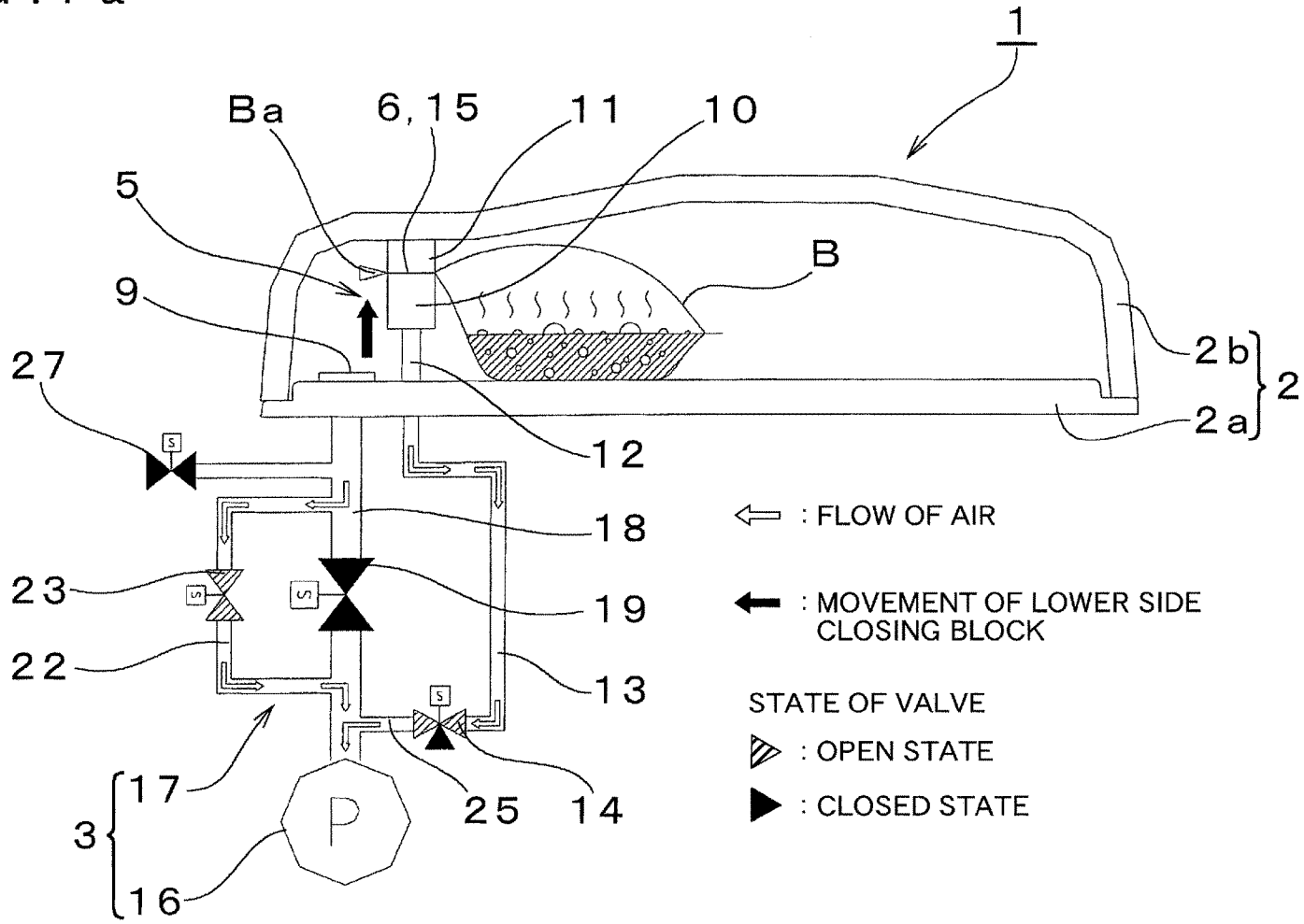
FIGS. 7(*a*) and 7(*b*) illustrate explanatory drawings of the vacuum packaging apparatus in a package decompressing process, of which FIG. 7(*a*) is a schematic diagram and FIG. 7(*b*) is a timing chart.
Figure 7B:
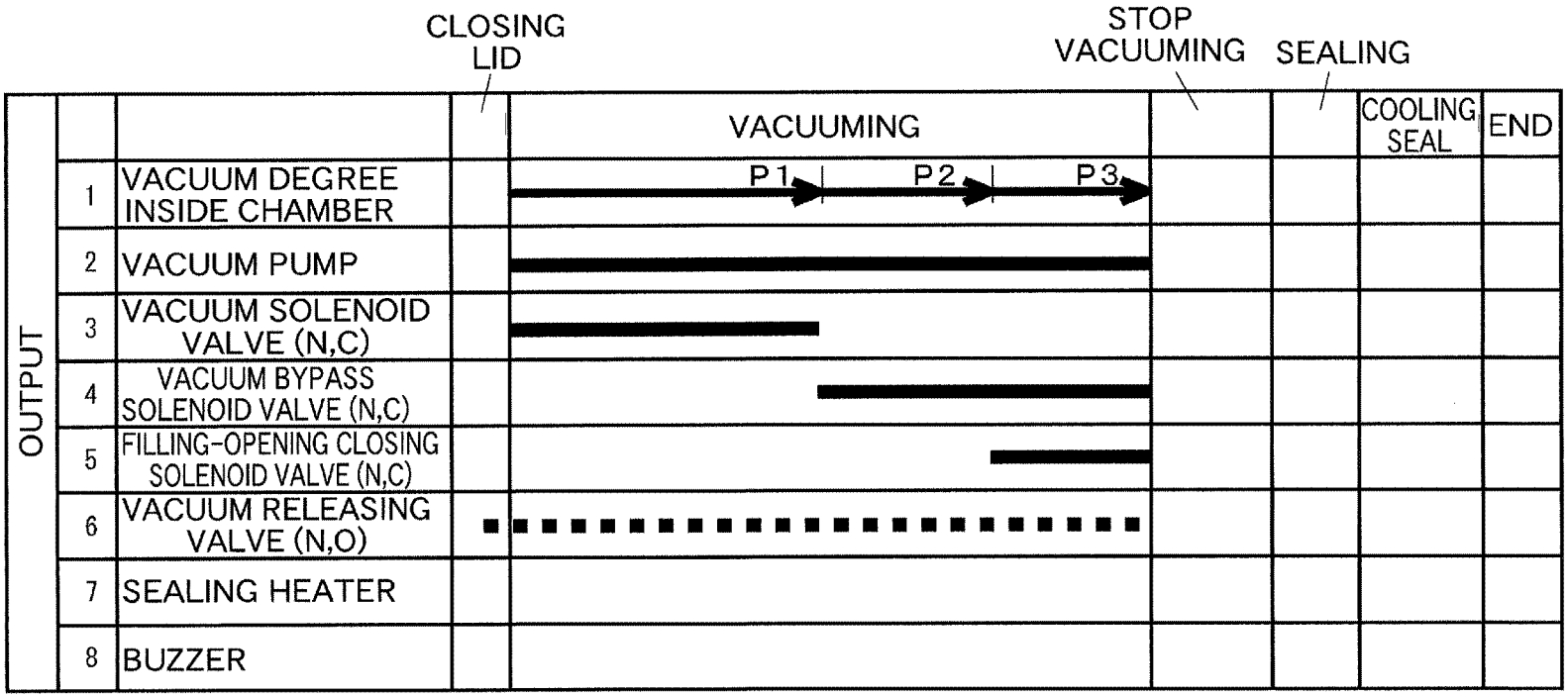

While the chamber 2 is continuously decompressed inside at the second decompression rate, when it is detected by the air-pressure detection sensor 34 that the chamber 2 is decompressed inside to the second set pressure P2 that is lower than the first set pressure P1, the process proceeds to a package decompressing process. In the package decompressing process, the controller 7 functions as a package decompression control means and controls the decompression operation and the closing operation of the packaged-object filling opening Ba inside the chamber 2. Specifically, as illustrated in FIGS. 7(*a*) and 7(*b*), the driving of the vacuum pump 16, the bypass communicating state (the closed state of the vacuum solenoid valve 19 and the open state of the vacuum bypass solenoid valve 23) of the decompression regulating mechanism 17, and the closed state of the vacuum releasing valve 27 are maintained. Furthermore, in the filling-opening closing solenoid valve 14, the connection port on the atmospheric releasing side is closed and the connection port on the filling-opening closing drive flow path 13 side and the connection port on the closing branching port 25 side are opened such that the air inside the closing cylinder 12 is suctioned; accordingly, the lower side closing block 10 is lifted and the packaging bag B is pinched between the upper side closing block 11 and the lower side closing block 10 such that the packaged-object filling opening Ba is closed. Moreover, in the chamber 2 that has been decompressed inside to the second set pressure P2, the liquid (water) inside the packaged object starts to boil and due to the gas (water vapor) generated by the vaporized liquid, the air pressure inside the packaging bag B becomes higher than the air pressure inside the chamber 2 and the packaging bag B becomes inflated. At this time, because the packaged-object filling opening Ba is closed by the filling-opening closing device 5, even if the second set pressure P2 is set at a pressure at which the liquid boils in a high temperature state inside the packaging bag B, in other words, even if sufficient degassing inside the packaging bag B is attempted by decompressing inside the chamber 2 to a pressure at which the liquid boils, a trouble in that the boiling liquid boils out from the packaging bag B can be avoided and, accordingly, the packaged-object filling opening Ba can be prevented from becoming dirty from liquid. Accordingly, even if a liquid is included in the packaged object, it is possible to sufficiently degasify inside the packaging bag B without any trouble; accordingly, bubbles are less likely to remain inside the packaging bag B after the vacuum packaging and it is possible to perform the vacuum packaging in a desirable manner. Furthermore, it is less likely for the gas that has been generated by vaporization of the boiling water to be drawn into the vacuum pump 16; accordingly, it is possible to suppress a defect from occurring in the vacuum pump 16 due to drawing in the generated gas. Furthermore, since the packaging bag B is pinched in an adhesive manner between the bag adhesive portions 15 that are each provided on the upper side closing block 11 and the lower side closing block 10, even if the packaging bag B becomes inflated due to boiling of the liquid, the packaged-object filling opening Ba is not displaced; accordingly, a trouble such as the packaging bag B in a pinched state slipping out from between the upper side closing block 11 and the lower side closing block 10 can be prevented and, consequently, unintended opening of the packaged-object filling opening Ba leading to a trouble such as the liquid boiling out can be prevented.

Figure 8A:
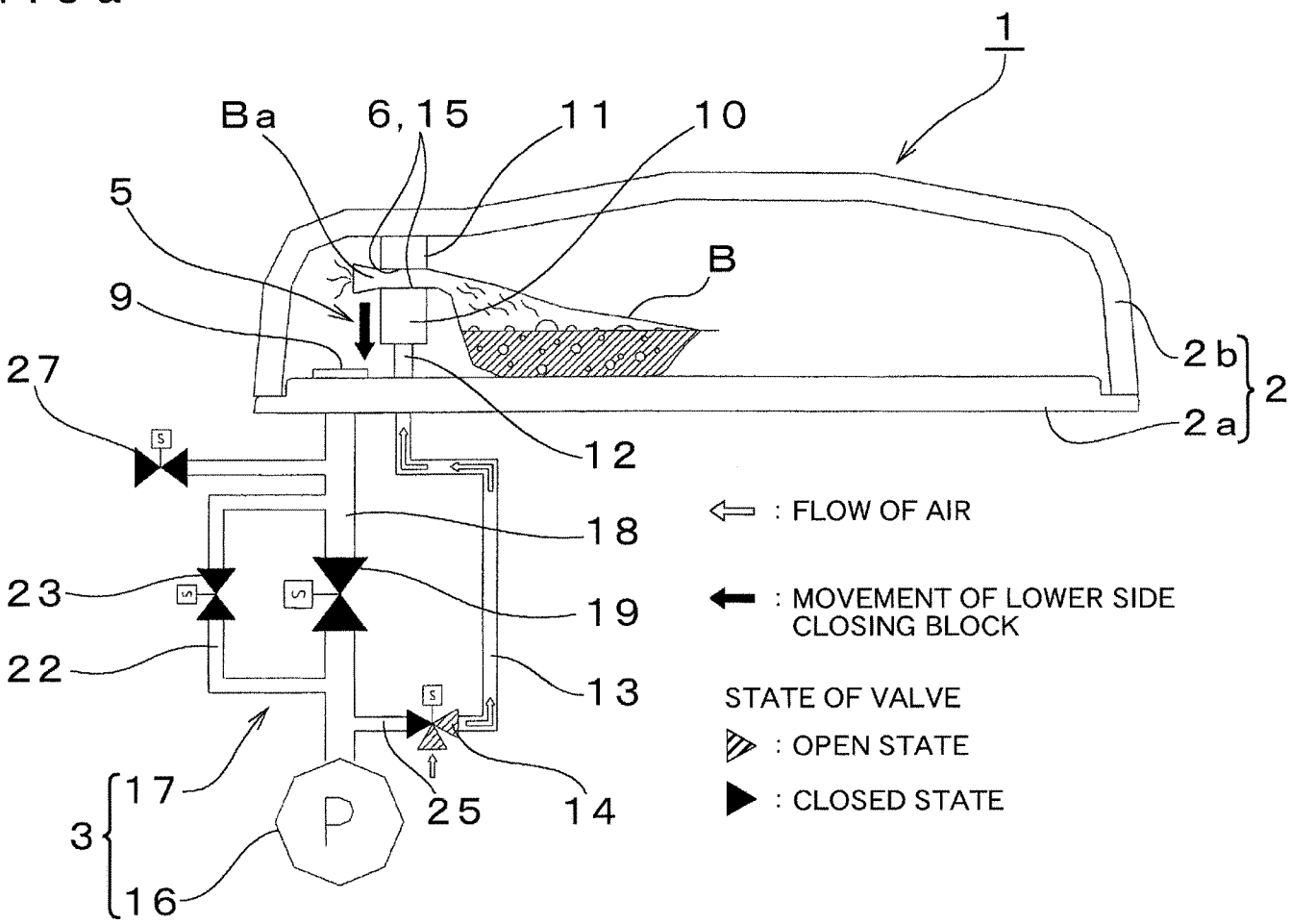
FIGS. 8(*a*) and 8(*b*) illustrate explanatory drawings of the vacuum packaging apparatus in a closing cancellation process, of which FIG. 8(*a*) is a schematic diagram and FIG. 8(*b*) is a timing chart.
Figure 8B:
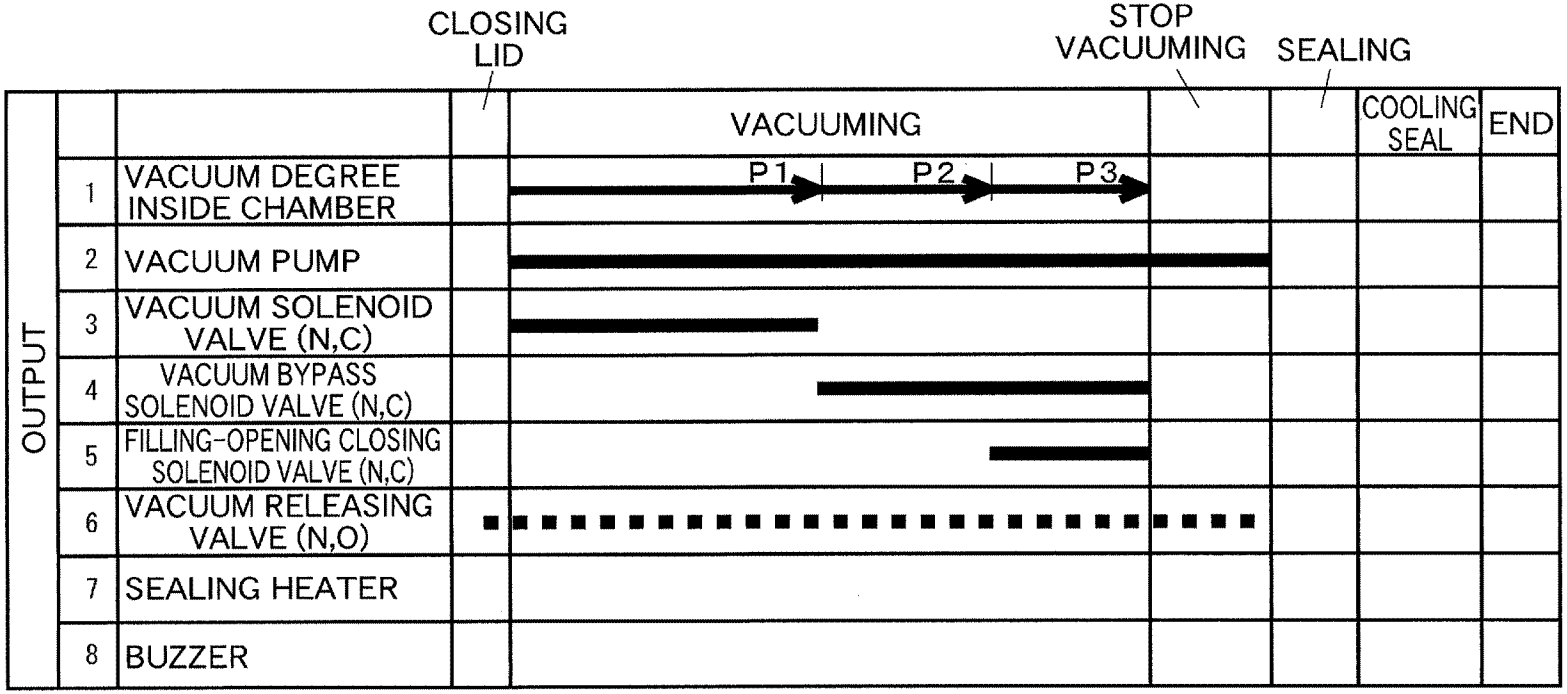

While the driving of the vacuum pump 16 is continued under the state in which the packaged-object filling opening Ba is closed, the chamber 2 is decompressed inside at the second decompression rate so as to keep the liquid inside the packaged object boiling, and when the air-pressure detection sensor 34 detects that the chamber 2 is decompressed inside to the third set pressure P3, the process proceeds to a closing cancellation process. In the closing cancellation process, the controller 7 functions as a closing cancellation control means and controls the operation of the decompression regulating mechanism 17 and the closing cancellation operation (releasing operation) of the packaged-object filling opening Ba. Specifically, as illustrated in FIGS. 8(*a*) and 8(*b*), while the closed state of the vacuum releasing valve 27 and the vacuum solenoid valve 19 is maintained, the vacuum bypass solenoid valve 23 is closed so as to stop degassing inside the chamber 2 (block the airflow between the chamber 2 and the vacuum pump 16) and to maintain the state in which decompression has been performed to the third set pressure P3. Moreover, the driving of the vacuum pump 16 is maintained for the next process, and in the filling-opening closing solenoid valve 14, the connection port on the closing branching port 25 side is closed and the connection port on the atmospheric releasing side is opened so that the inside of the closing cylinder 12 is released to the atmosphere; accordingly, the lower side closing block 10 is lowered and is separated from the upper side closing block 11 and the packaged-object filling opening Ba of the packaging bag B in the inflated state inside the chamber 2 decompressed to the third set pressure P3 is released, in other words, the closed state of the packaged-object filling opening Ba is canceled. With the above, gas that has been generated inside the packaging bag B is emitted into the chamber 2 through the packaged-object filling opening Ba and, further, the residue air that had not been drawn out (degassed) from inside the packaging bag B in the preparatory decompression process and the package decompressing process is also emitted to the outside of the packaging bag B together with the gas. At this time, since the bag adhesive portions 15 are adhered to the surface of the packaging bag B, even if the inside surfaces of the packaged-object filling opening Ba in the closed state are adhered to each other by liquid included in the packaged object, the packaged-object filling opening Ba can be smoothly opened and released.

Figure 9A:
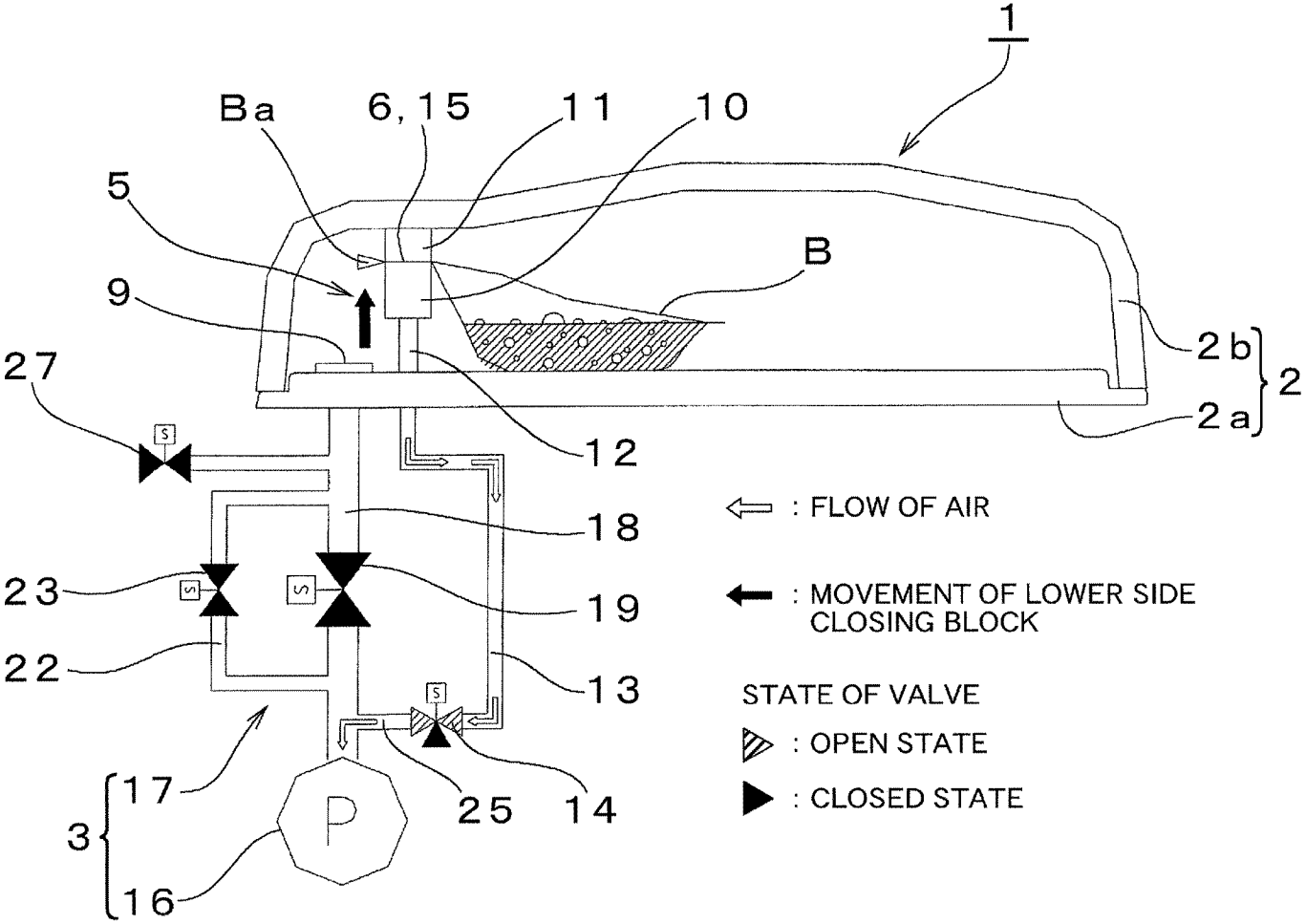
FIGS. 9(*a*) and 9(*b*) illustrate explanatory drawings of the vacuum packaging apparatus in a sealing process, of which FIG. 9(*a*) is a schematic diagram and FIG. 9(*b*) is a timing chart.
Figure 9B:
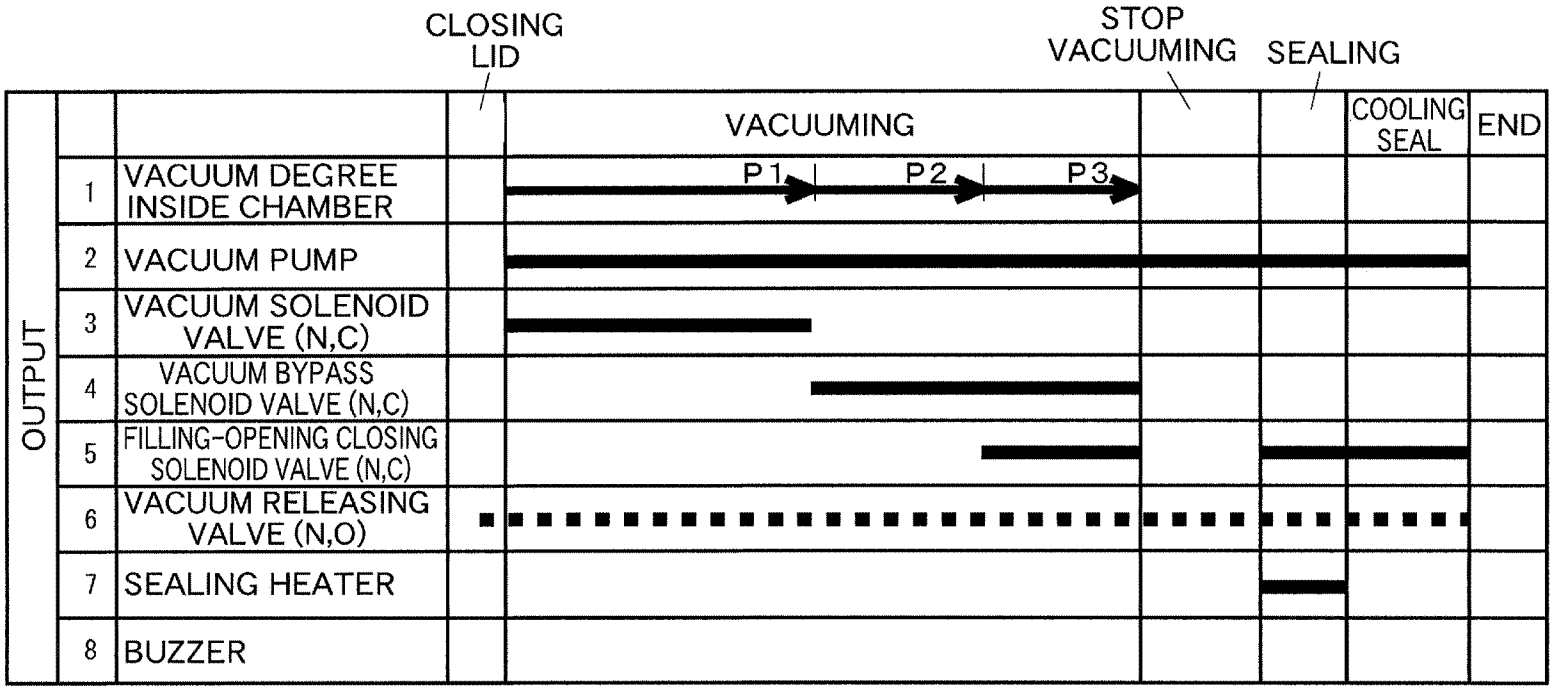

Upon release of the packaged-object filling opening Ba and emission of the gas and the residue air from the packaging bag B, the process proceeds to a sealing process. In the sealing process, the controller 7 functions as sealing control means and controls the reclosing operation of the packaged-object filling opening Ba. Specifically, as illustrated in FIGS. 9(*a*) and 9(*b*), the closed state of the vacuum releasing valve 27, the vacuum solenoid valve 19, and the vacuum bypass solenoid valve 23 is maintained and the decompress state inside the chamber 2 is maintained. Furthermore, the driving of the vacuum pump 16 is maintained and, in the filling-opening closing solenoid valve 14, while the open state of the connection port on the filling-opening closing drive flow path 13 side is maintained, the connection port on the atmospheric releasing side is closed and the connection port on the closing branching port 25 side is opened such that the air inside the closing cylinder 12 is suctioned; accordingly, the lower side closing block 10 is lifted again and the packaging bag B is pinched between the upper side closing block 11 and the lower side closing block 10 such that the packaged-object filling opening Ba is closed again. When the packaged-object filling opening Ba is closed again, in this state, the sealing heaters 6 are energized and the packaged-object filling opening Ba in the closed state is heated so as to be heat sealed (sealed).

Figure 10A:
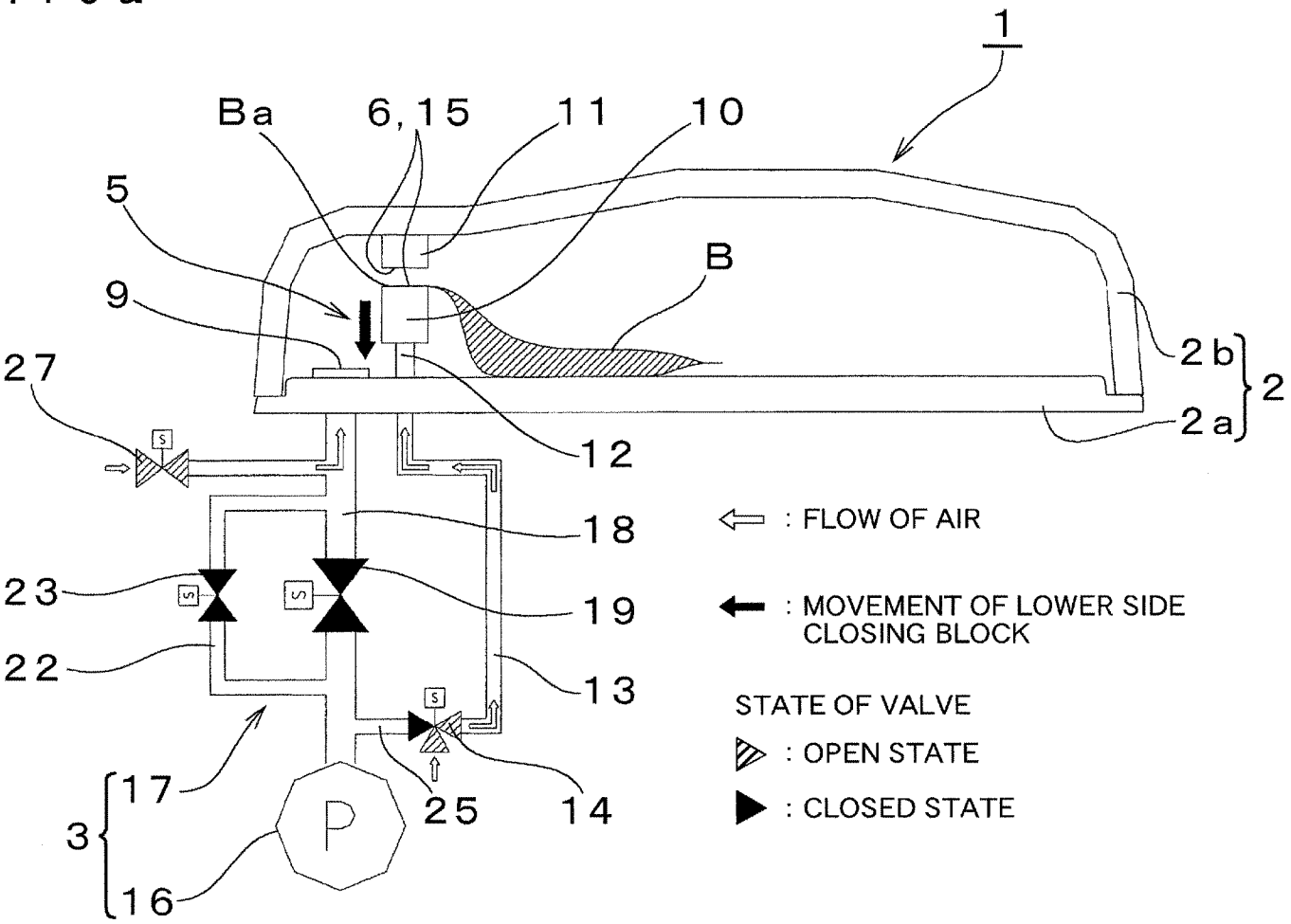
FIGS. 10(*a*) and 10(*b*) illustrate explanatory drawings of the vacuum packaging apparatus after the completion of sealing process, of which FIG. 10(*a*) is a schematic diagram and FIG. 10(*b*) is a timing chart.
Figure 10B:
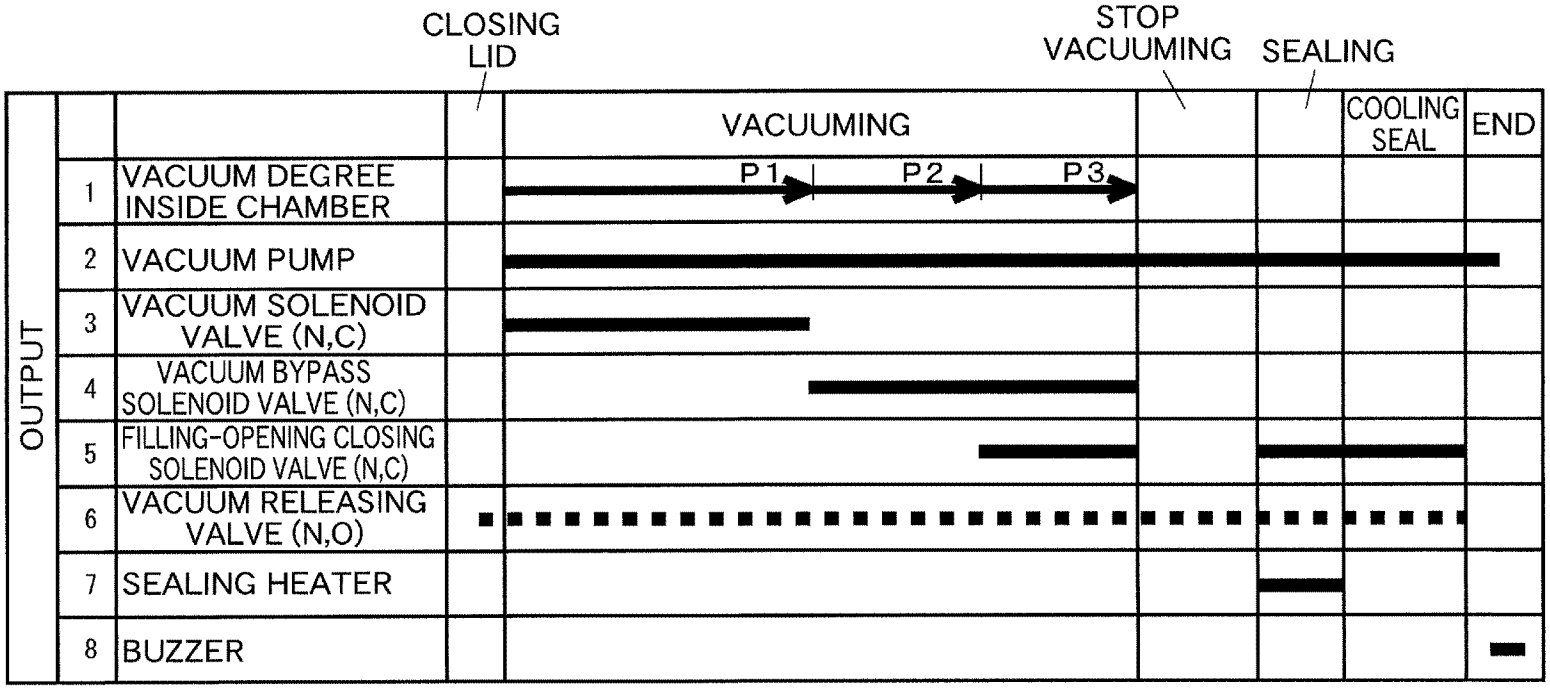

When the heat sealing of the packaged-object filling opening Ba is completed, energization of the sealing heaters 6 is stopped and the pinched state created by the filling-opening closing device 5 is maintained until a cooling time of the packaged-object filling opening Ba elapses. Moreover, after the elapse of the cooling time, as illustrated in FIGS. 10(*a*) and 10(*b*), in the filling-opening closing solenoid valve 14, the connection port on the closing branching port 25 side is closed and the connection port on the atmospheric releasing side is opened so that the inside of the closing cylinder 12 is released to the atmosphere; accordingly, the lower side closing block 10 is lowered and is separated from the upper side closing block 11, and pinching of the packaging bag B in the sealed state is canceled. Furthermore, the vacuum releasing valve 27 is opened so as to return the inside of the chamber 2 to atmospheric pressure, and after stopping the driving of the vacuum pump 16, an alarm sound is generated by the buzzer 36 to notify the end of the vacuum packaging.

Note that even if bubbles are generated inside the packaging bag B immediately after the end of the vacuum packaging, most of the bubbles are not residue air but are the liquid included in the packaged object that has been vaporized. Accordingly, when the packaged object is cooled to the normal temperature, the bubbles are condensed inside the packaging bag B and returns to liquid. As a result, even if there is a packaged object that includes liquid, it is possible to obtain a desirably vacuumed package that has scarcely any bubble.

In the vacuum packaging performed in the above manner, since the second set pressure P2 is set at a pressure at which the liquid included in the packaged object boils under the temperature when accommodated inside the packaging bag B, it is possible to force the air inside the packaging bag B to the outside with the gas generated through vaporization of the boiled liquid; accordingly, the packaging bag B can be sufficiently degassed inside. Accordingly, it is possible to perform vacuum packaging in a desirable manner that is less likely to contain residue air (in other words, with scarcely any bubble). Furthermore, since the decompression regulating mechanism 17 of the vacuum packaging apparatus 1 is constituted by the suction-air flow path 18, the bypass flow path 22, the vacuum solenoid valve 19, and the vacuum bypass solenoid valve 23, the decompression regulating mechanism 17 can be made with a simple configuration. Note that in the embodiment described above, while the second set pressure P2 is set at a pressure at which the liquid starts to boil, the present invention is not limited to this setting. For example, a pressure that is lower than the pressure at which the liquid starts to boil may be the second set pressure P2.

Incidentally, in the above-described embodiment, the first to third set pressures are set by input operations on the control panel (configuration switches 33 and the like); however, the present invention is not limited to this. For example, before the main operation (before the actual vacuum packaging operation) of the vacuum packaging apparatus 1, a trial operation (sampling) may be performed in order to obtain data of each set pressure while the operator monitors the state of the liquid inside the packaging bag B, and, when the operator operates the control panel at the point when the liquid boils, the air-pressure detection sensor 34 may detect the pressure at the boiling point and store the pressure as the second set pressure P2. Furthermore, the stored second set pressure P2 may be added with or subtracted by preset pressure differences such that the third set pressure P3 and the first set pressure P1 are calculated and stored, and, each of the stored set pressures may be used to perform the main operation of the vacuum packaging apparatus 1.

Figure 11:
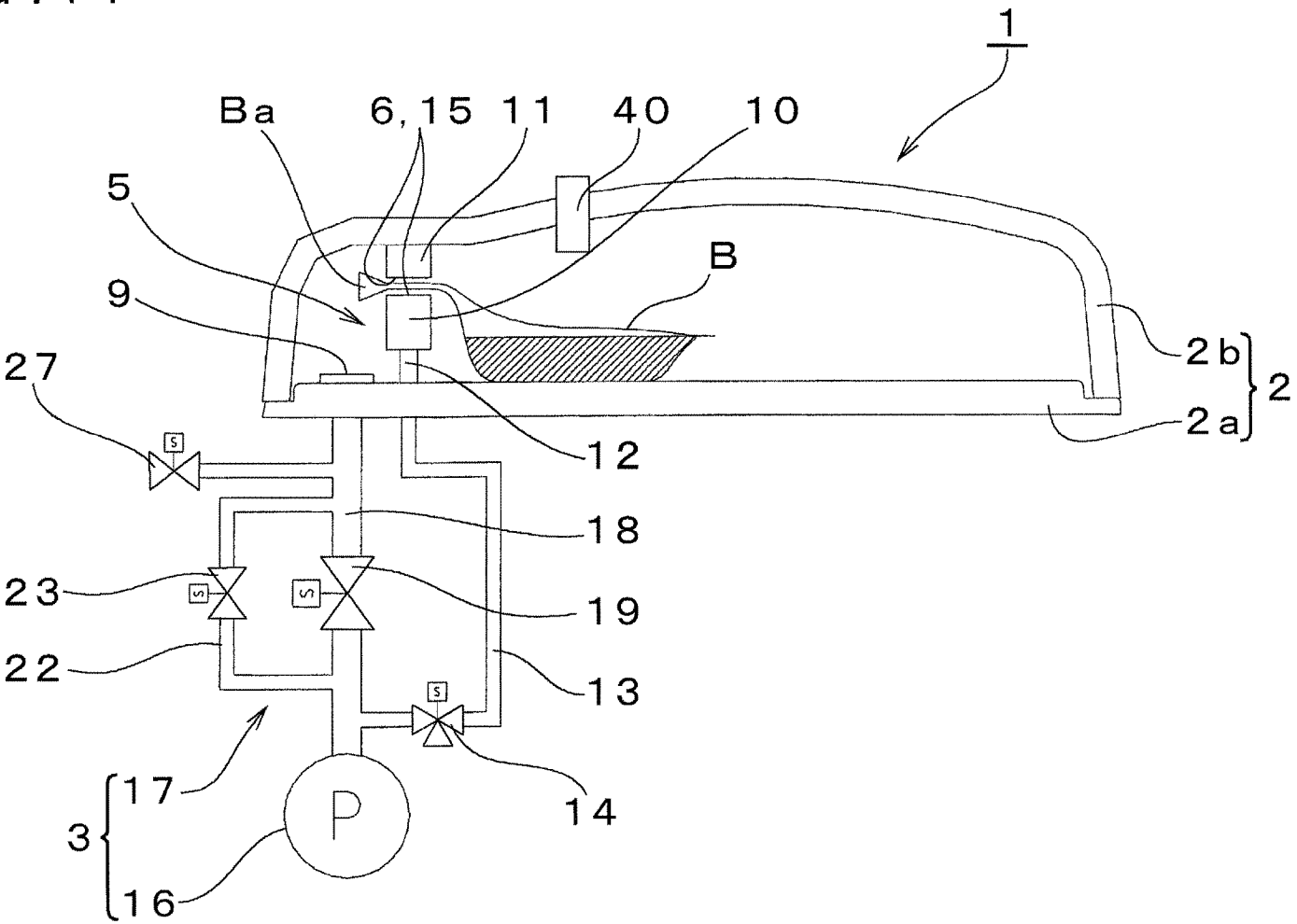
FIG. 11 is a schematic diagram of a vacuum packaging apparatus including a temperature detection sensor.
Figure 12:
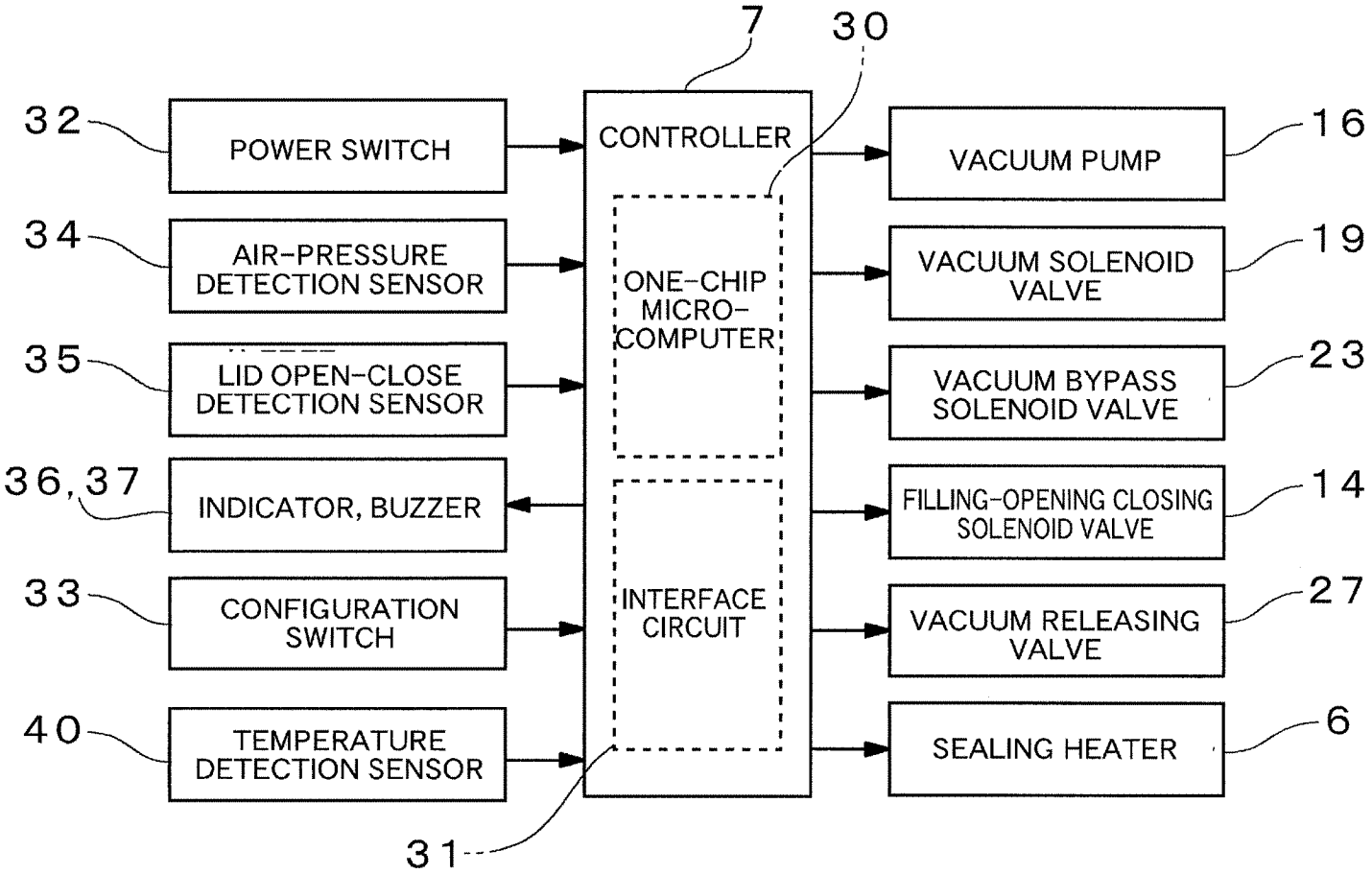
FIG. 12 is a block diagram illustrating a control system of the vacuum packaging apparatus including the temperature detection sensor.

Furthermore, temperatures of the packaged object inside the packaging bag B accommodated in the chamber 2 may be allowed to be detected and the detected temperature and data, which has been stored in advance in the controller 7, may be compared in order to set each of the set pressures. For example, in a second embodiment illustrated in FIGS. 11 and 12, the lid portion 2*b* of the chamber 2 is provided with a temperature detection sensor 40 that is capable of detecting, in a contactless manner, the temperature of the packaged object inside the packaging bag B accommodated in the chamber 2, and information of the temperature detected by the temperature detection sensor 40 is, as a signal, capable of being transmitted to the interface circuit 31 of the controller 7. Furthermore, in the controller 7, data of a boiling start pressure table (for example, data of a water vapor pressure table illustrated in FIG. 3) that sets forth the correlation between the temperature of the liquid (for example, water) included in the package object and the pressure at which the liquid with the above temperature starts to boil is stored in advance.

Note that the installing position of the temperature detection sensor 40 is, provided that the temperature of the packaged object inside the packaging bag B can be detected, not limited to the lid portion 2*b*. Furthermore, in the second embodiment, the surface temperature of the packaging bag B, in which the packaged object is received, is detected by the temperature detection sensor 40 and the detection temperature is processed as the temperature of the packaged object; however, it goes without saying that the temperature of the packaged object may be directly detected by having the temperature detection sensor come in contact with the packaged object. However, if the packaged object is a foodstuff, it is desirable that the noncontact type temperature detection sensor is adopted.

In the vacuum packaging apparatus 1 provided with such a configuration, after setting the packaging bag B inside the chamber 2 during the setting process, the lid portion 2*b* is closed, and when the lid open-close detection sensor 35 detects the closed state of the lid portion 2*b* and sends a signal to the controller 7, the temperature detection sensor 40 detects the temperature of the packaged object inside the packaging bag B and transmits information of the detected temperature to the controller 7. Then, the controller 7 having received the temperature information refers to the data in the boiling start pressure table and determines the pressure at which the liquid having the detection temperature of the package object starts to boil as the second set pressure P2, and further, adds and subtracts the preset temperature differences to and from the second set pressure P2 so as to set the third set pressure P3 and the first set pressure P1. Furthermore, the temperature detected by the temperature detection sensor 40 and each of the set pressures set by the controller 7 are indicated on the indicator 37 of the control panel.

As described above, by detecting the temperature of the packaged object inside the chamber 2 and setting each of the set pressures on the basis of the detection temperature, even if the temperature of the packaged object is different each time the vacuum packaging operation is performed, each of the set pressures suitable for the packaged object, in other words, the operation of the vacuum packaging apparatus 1 suitable for the packaged object, can be set; accordingly, it is possible to perform a vacuum packaging operation in which liquid is not easily boiled out.

Note that in the above-described second embodiment, instead of storing the data of the boiling start pressure table in the controller 7, and arithmetic expression that calculates the pressure at which the liquid starts to boil from the temperature of the liquid may be installed such that when information of the temperature of the liquid is input to the controller 7 from the temperature detection sensor 40, the controller 7 may calculate the pressure using the arithmetic expression and set the second set pressure P2. Furthermore, a numerical value after adding or subtracting a preset correction pressure difference to or from the pressure (the pressure at which the liquid starts to boil) that has been determined or calculated on the basis of the temperature information of the liquid may be set as the second set pressure P2.

Incidentally, in each of the above-described embodiments, when the chamber 2 is decompressed inside to the third set pressure P3 that has been set in advance, degassing inside the chamber 2 is stopped; however, the present invention is not limited to this configuration. For example, in a third embodiment illustrated in FIG. 13, while basically similar to the second embodiment, the third set pressure is not set, and, alternatively, the inflated state of the packaging bag B (specifically, the packaging bag B in which the liquid is boiling inside) is detected and on the basis of the detection result, degassing inside the chamber 2 is stopped.

Figure 13:
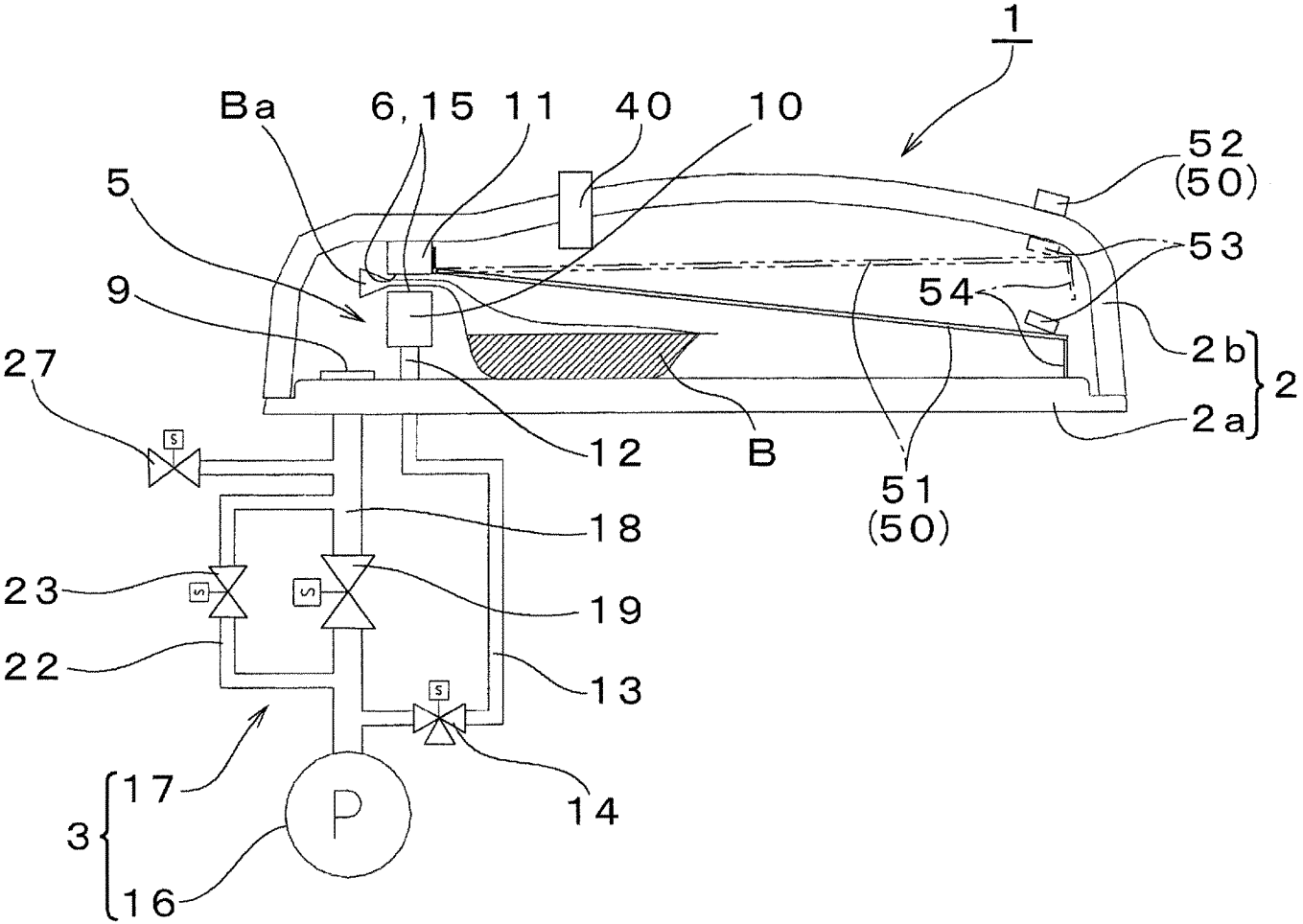
FIG. 13 is a schematic diagram of a vacuum packaging apparatus including the temperature detection sensor and an inflation detection means.

Specifically described, as illustrated in FIG. 13, in the chamber 2 of the vacuum packaging apparatus 1 according to the third embodiment, an inflation detection means 50 that is capable of detecting the inflated state of the packaging bag B is provided. The inflation detection means 50 includes a tabular bag abutting portion 51 that is placed on the body portion 2*a* and that is positioned above the packaging bag B, and an inflation detection sensor 52 that is capable of detecting the inflated state of the packaging bag B by the change in position of the bag abutting portion 51. Moreover, the bag abutting portion 51 is configured such that an end portion (a left end portion in FIG. 13) of the bag abutting portion 51 on the filling-opening closing device 5 side is pivotally attached to a side portion of the upper side closing block 11 in a pivotal manner and a free end portion positioned on the pivotally attached side of the lid portion 2*b* (the right end portion in FIG. 13) is lifted and lowered (moved in the up-down direction) such that the free end portion can be changed between a lifted position (the position illustrated by the solid line in FIG. 13) in which the free end portion is positioned on the lid portion 2*b* side and a lowered position (the position illustrated by the two-dot chain line in FIG. 13) in which the free end portion is positioned on the body portion 2*a* side. Furthermore, in the bag abutting portion 51, an opening portion (not shown) that makes the temperature detection sensor 40 face the packaging bag B is open so as to prevent the temperature detection sensor 40 from erroneously detecting the temperature of the bag abutting portion 51.

Figure 14:
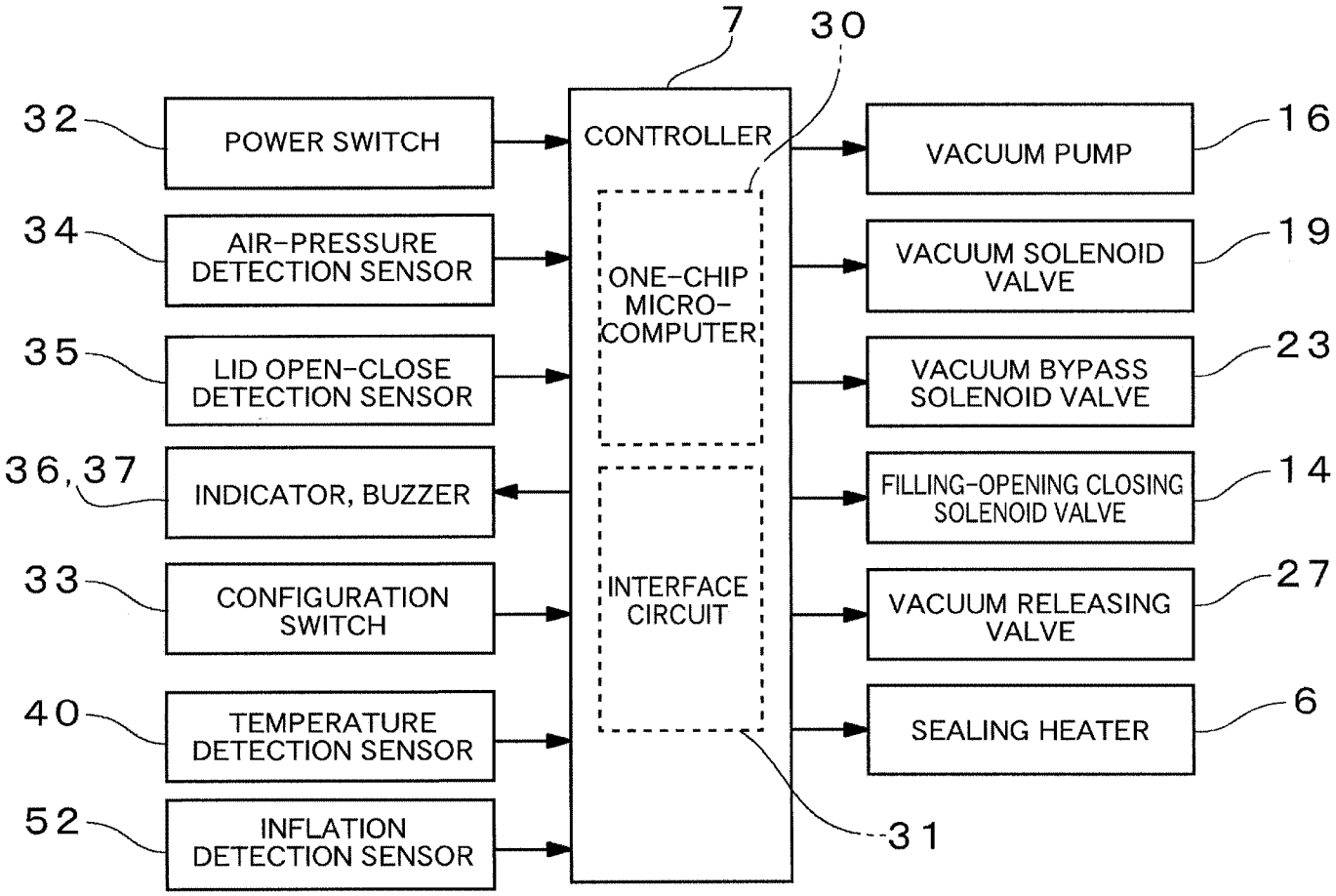
FIG. 14 is a block diagram illustrating a control system of the vacuum packaging apparatus including the temperature detection sensor and the inflation detection means.

Furthermore, a detection piece 53 is provided on the upper surface (the surface facing the lid portion 2*b* side) of the free end portion of the bag abutting portion 51, and a stopper 54 that prevents the free end portion from abutting against the body portion 2*a* is provided on the undersurface. Moreover, in the chamber 2, at a portion above the detection piece 53, the inflation detection sensor 52 that is capable of detecting the detection piece 53 of the bag abutting portion 51 in the lifted position is provided such that the detection signal of the inflation detection sensor 52 can be transmitted to the interface circuit 31 of the controller 7 (see FIG. 14). Note that in the present embodiment, the inflation detection sensor 52 is constituted by a magnetic sensor and the detection piece 53 is constituted by a magnetic body, and the strength of the magnetic field changed by approach of the detection piece 53 is detected by the inflation detection sensor 52; accordingly, change in position of the bag abutting portion 51 can be detected.

Figure 15:
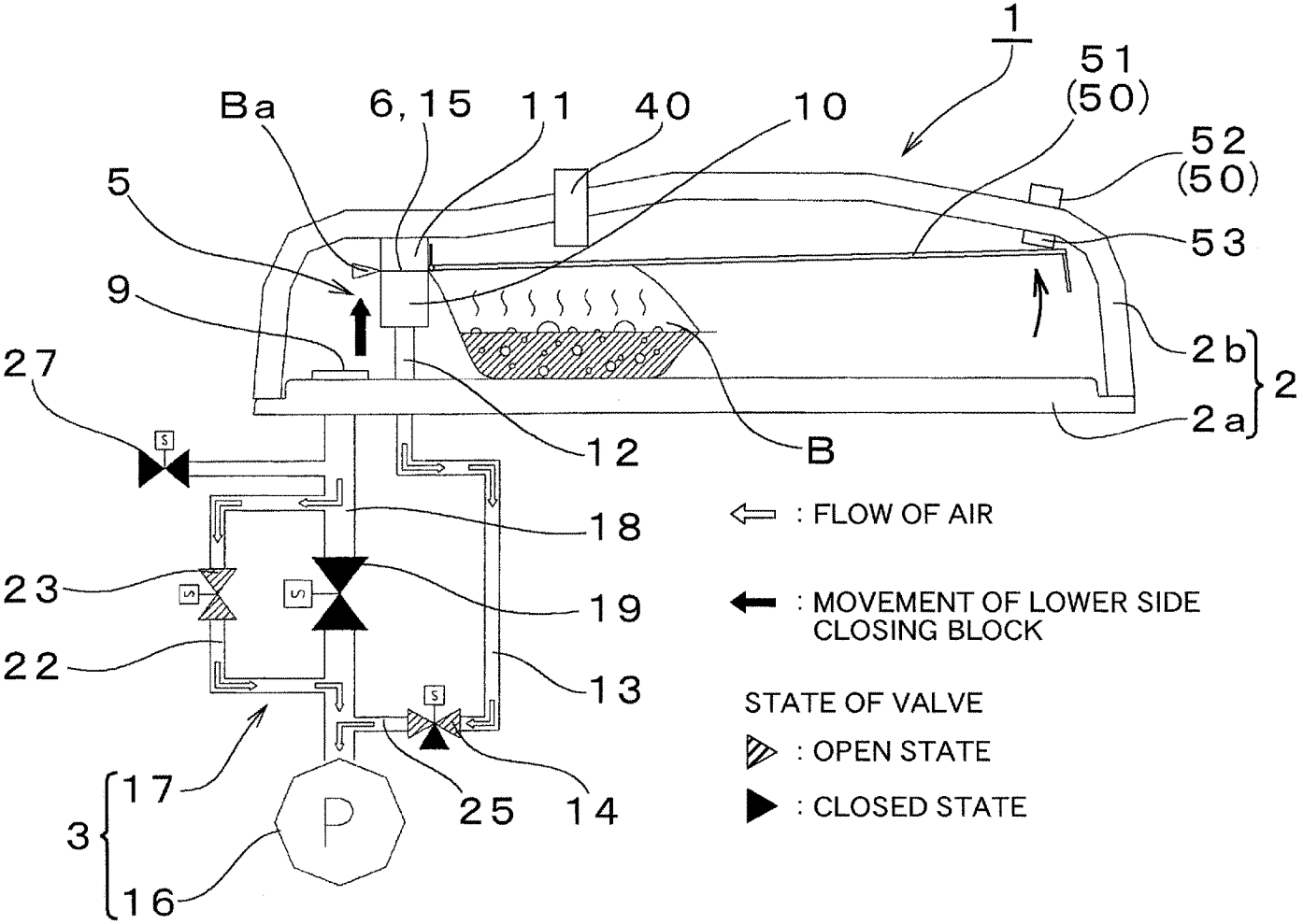
FIG. 15 is a schematic diagram of the vacuum packaging apparatus in the package decompressing process including the temperature detection sensor and the inflation detection means.

In the package decompressing process of the vacuum packaging apparatus 1 including the inflation detection means 50 configured as above, as illustrated in FIG. 15, inside the chamber 2 that has been decompressed to the second set pressure P2, inside the packaging bag B in a state in which the packaged-object filling opening Ba is closed, the liquid (water) inside the packaged object starts to boil and due to the gas (water vapor) generated by the vaporized liquid, the air pressure inside the packaging bag B becomes higher than the air pressure inside the chamber 2 and the packaging bag B becomes inflated. Then, on the basis of the control of the controller 7 serving as the package decompression control means, when the driving of the vacuum pump 16 is continued while the packaged-object filling opening Ba is in a closed state and when boiling of the liquid inside the packaged object is continued while decompressing inside the chamber 2 at the second decompression rate, the upper surface of the inflated packaging bag B abuts against the bag abutting portion 51. When the driving of the vacuum pump 16 is further continued and when the packaging bag B is further inflated, the bag abutting portion 51 is pushed up by the packaging bag B and is changed to the lifted position from the lowered position such that the detection piece 53 of the bag abutting portion 51 at the lifted position is detected by the inflation detection sensor 52.

Figure 16:
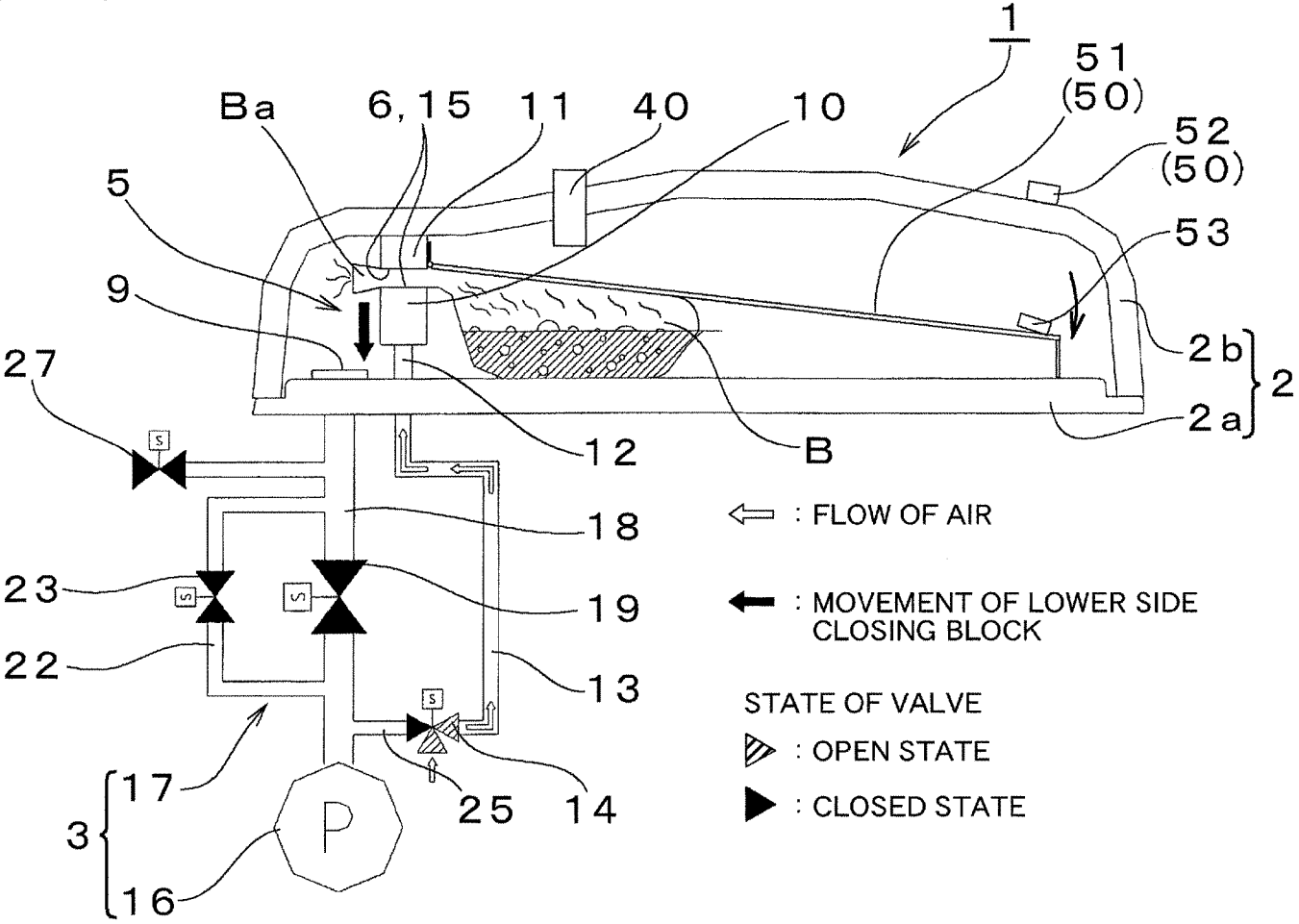
FIG. 16 is a schematic diagram of the vacuum packaging apparatus in the closing cancellation process including the temperature detection sensor and the inflation detection means.

When the controller 7 receives a detection signal implying that the detection piece 53 has been detected by the inflation detection sensor 52 (in other words, a detection signal implying that the inflation of the packaging bag B has been detected), the vacuum packaging apparatus 1 proceeds to the closing cancellation process and the controller 7 functions as a closing cancellation control means. Then, as illustrated in FIG. 16, degassing inside the chamber 2 is stopped (airflow between the chamber 2 and the vacuum pump 16 is blocked) and the lower side closing block 10 is lowered and is separated from the upper side closing block 11 so as to release the packaged-object filling opening Ba of the packaging bag B in the inflated state, in other words, the closed state of the packaged-object filling opening Ba is canceled. With the above, gas that has been generated inside the packaging bag B is emitted into the chamber 2 through the packaged-object filling opening Ba and, further, the residue air that had not been drawn out (degassed) from inside the packaging bag B in the preparatory decompression process and the package decompressing process is also emitted to the outside of the packaging bag B together with the gas. Furthermore, the bag abutting portion 51 that had been changed to the lifted position by the inflation of the packaging bag B moves downwards by its own weight and returns to the lowered position, and squashes the inflated packaging bag B. With the above, residue gas (air and the gas) that remains inside the packaging bag B can be forced to the outside by using the configuration that detects the inflated state of the packaging bag B and the inside of the packaging bag B can be degassed sufficiently. Accordingly, it is possible to perform vacuum packaging in a desirable manner that is less likely to contain residue air.

Furthermore, since degassing inside the chamber 2 is stopped when the inflated state of the packaging bag B is detected, it is easy to understand the timing to stop degassing inside the chamber 2 on the basis of the inflation of the packaging bag B, in other words, the boiling state of the liquid. Accordingly, a trouble such as excessive decompression inside the chamber 2 and, consequently, a trouble in that a large amount of vapored gas, which is the result of excessive boiling of the liquid inside the packaging bag B, being drawn into the degasifier 3 (specifically, the vacuum pump 16) can be avoided.

Note that the bag abutting portion 51 is not limited to the configuration in which a flat plate is pivotally attached to the upper side closing block 11. The point is, any configuration may be adopted as long as the bag abutting portion 51 is disposed inside the chamber 2 and above the packaging bag B so as to be allowed to be lifted and lowered, is lifted up by the inflated packaging bag B, and is capable of being placed on the upper surface of the packaging bag B in the inflated state and squashing the packaging bag B. For example, the bag abutting portion 51 may be a member that can be lifted and lowered along a columnar slide guide that is provided in an erect manner inside the chamber 2, or may be a member that is hanged down from inside the lid portion 2*b* with a chain, a rope, or the like. Furthermore, the bag abutting portion may be configured to be biased at all times to the packaging bag B side therebelow with a biasing force of a biasing member such as a spring or the like such that in the package decompressing process, the inflating packaging bag B resists the biasing force of the biasing member and lifts the bag abutting portion up, and in the closing cancellation process, the bag abutting portion squashes the packaging bag B in the inflated state with the biasing force of the biasing member. Furthermore, the inflation detection sensor 52 is not limited to a magnetic sensor but may be any component that can detect the change in the state of the bag abutting portion 51 that is associated with the inflation of the packaging bag B. For example, the inflation detection sensor may be constituted by a mechanical sensor such as a micro switch.

Furthermore, the inflation detection means is not limited to a configuration including a bag abutting portion as long as the inflation of the packaging bag B can be detected in the package decompressing process. For example, the inflation detection means may be means (detecting means based on image recognition) that is provided with a monitoring camera that takes a picture of the packaging bag B inside the chamber 2, stores data of an image of the packaging bag B in the inflated state taken in advance in the controller 7, and compares the image of the packaging bag B taken by the monitoring camera and the data so as to detect the inflated state of the packaging bag B.

Incidentally, in each of the above-described embodiments, after the chamber 2 is decompressed inside to the first set pressure at the first decompression rate, decompression is performed at the second decompression rate that is slower than the first decompression rate; however, the present invention is not limited to this configuration. If no trouble during the vacuum packaging process such as bumping of the liquid occurs before reaching the second set pressure (before-closing-filling-opening set pressure) P2, the chamber 2 may be decompressed inside to the second set pressure P2 at a constant decompression rate. In other words, without performing the preparatory decompression process, the vacuum packaging process may be performed through the package decompressing process, the closing cancellation process, and the sealing process.

Furthermore, in each of the above-described embodiments, the sealing heater 6 and the bag adhesive portion 15 are provided on each of the upper side closing block 11 and the lower side closing block 10 such that the filling-opening closing device and the sealing device according to the present invention are integrally formed; however the present invention is not limited to this configuration. The point is, it is only sufficient that the filling-opening closing device that closes the packaged-object filling opening, and the sealing device that seals the packaged-object filling opening are provided in the vacuum packaging apparatus and, for example, the filling-opening closing device and the sealing device may be provided separately inside the chamber 2. Furthermore, the decompression regulating mechanism 17 is configured so as to include the suction-air flow path 18 and the bypass flow path 22; however, the present invention is not limited to this configuration. The point is, the decompression regulating mechanism may be made by any configuration as long as the decompression rate inside the chamber decompressed by the driving of the vacuum pump can be controlled. Furthermore, an example has been illustrated in which the liquid included in the packaged object is water having a high temperature rather than a normal temperature; however, the present invention is not limited to this configuration. The liquid included in the packaged object may be a liquid composed of a component other than water and, for example, may be edible oil for soaking a foodstuff or may be a liquid (formalin or the like in which a biological specimen is immersed) other than foodstuffs. Furthermore, the temperature of the liquid may be at a normal temperature or lower.

Furthermore, the vacuum packaging apparatus according to each of the above-described embodiments may be configured to allow a conventional vacuum packaging process (a vacuum packaging process that decompresses at a constant decompressing rate and that does not close and release the packaged-object filling opening before sealing) to be carried out, and when a packaged object including a liquid (for example, a liquid having a normal temperature) that has no risk of bumping is vacuum packaged, the conventional vacuum packaging process may be allowed to be performed by changing the settings with the operation of the control panel by the user.

REFERENCE SIGNS LIST

1 vacuum packaging apparatus
2 chamber
  2*a* body portion
  2*b* lid portion
3 degasifier
5 filling-opening closing device
6 sealing heater
7 controller
9 suction opening
10 lower side closing block
11 upper side closing block
12 closing cylinder
13 filling-opening closing drive flow path
14 filling-opening closing solenoid valve
15 bag adhesive portion
16 vacuum pump
17 decompression regulating mechanism
18 suction-air flow path
19 vacuum solenoid valve
20 chamber-side branching port
21 pump-side branching port
22 vacuum bypass flow path
23 vacuum bypass solenoid valve
25 closing branching port
26 vacuum releasing branching port
27 vacuum releasing valve
30 one-chip microcomputer
31 interface circuit
32 power switch
33 configuration switch
34 air-pressure detection sensor
35 lid open-close detection sensor
36 buzzer
37 indicator
40 temperature detection sensor
50 inflation detection means
51 bag abutting portion
52 inflation detection sensor
53 detection piece
54 stopper
  B packaging bag
    Ba packaged-object filling opening

The invention claimed is:

1. A vacuum packaging method of packaging a liquid-containing object in a packaging bag having an opening to insert the object, using a vacuum packaging apparatus having a chamber in which the packaging bag containing the object is set and an inflation detector is provided to detect inflation of the packaging bag, comprising the steps of:

closing the opening of the packaging bag;

decompressing the chamber, resulting in inflation of the packaging bag and boiling of the liquid in the packaging bag;

detecting the inflation of the packaging bag with the inflation detector;

opening the opening of the packaging bag, if the inflation is detected, to release a gas from the packaging bag into the chamber;

sealing the opening of the packaging bag after releasing the gas; and returning the pressure inside the chamber to the pressure before the decompressing.

2. The vacuum packaging method according to claim 1, wherein decompressing the chamber is stopped if the inflation detector detects the inflation of the packaging bag.

3. The vacuum packaging method according to claim 1, wherein the inflation detector includes a bag abutting portion that abuts against an upper portion of the packaging bag and an inflation detection sensor that detects a change in position of the bag abutting portion.

4. The vacuum packaging method according to claim 1, wherein the liquid is soup.

5. A vacuum packaging method of packaging a liquid-containing object in a packaging bag having an opening to insert the object, using a vacuum packaging apparatus having a chamber in which the packaging bag containing the object is set and an inflation detector is provided to detect inflation of the packaging bag, comprising the steps of:

decompressing the chamber;

closing the opening of the packaging bag;

further decompressing the chamber, resulting in inflation of the packaging bag and boiling of the liquid in the packaging bag;

detecting the inflation of the packaging bag with the inflation detector;

opening the opening of the packaging bag, if the inflation is detected, to release a gas from the packaging bag into the chamber;

sealing the opening of the packaging bag after releasing the gas; and returning the pressure inside the chamber to the pressure before the decompressing.

6. The vacuum packaging method according to claim 5, wherein decompressing the chamber is stopped if the inflation detector detects the inflation of the packaging bag.

7. The vacuum packaging method according to claim 5, wherein the inflation detector includes a bag abutting portion that abuts against an upper portion of the packaging bag and an inflation detection sensor that detects a change in position of the bag abutting portion.

8. The vacuum packaging method according to claim 5, wherein the liquid is soup.

9. A vacuum packaging apparatus, comprising;

a chamber that accommodates a packaging bag having an opening to insert a liquid-containing object;

a pump that decompresses the chamber to degas inside of the packaging bag;

a closing device that is provided in the chamber to close the opening of the packaging bag;

a sealing device that seals the opening of the packaging bag;

an inflation detector which detects an inflation of the packaging bag;

a valve which brings the chamber to an atmospheric pressure; and a controller that controls the pump, the closing device, the sealing device, the inflation detector and the valve, wherein the controller performs closing the opening of the packaging bag;

decompressing the chamber, resulting in inflation of the packaging bag and boiling of the liquid in the packaging bag;

detecting the inflation of the packaging bag with the inflation detector;

opening the opening of the packaging bag, if the inflation is detected, to release a gas from the packaging bag into the chamber;

sealing the opening of the packaging bag after releasing the gas; and returning the pressure inside the chamber to the pressure before the decompressing.

10. The vacuum packaging apparatus according to claim 9, wherein the controller performs stopping the decompression if the inflation detector detects the inflation of the packaging bag.

11. The vacuum packaging apparatus according to claim 9, wherein the inflation detector includes a bag abutting portion that abuts against an upper portion of the packaging bag and an inflation detection sensor that detects a change in position of the bag abutting portion.

* * * * *